US007832552B2

(12) United States Patent
Newman

(10) Patent No.: US 7,832,552 B2
(45) Date of Patent: Nov. 16, 2010

(54) DUO PACKAGING FOR DISPOSABLE SOFT CONTACT LENSES USING A SUBSTRATE

(75) Inventor: Stephen D. Newman, Bayshore Park (SG)

(73) Assignee: Menicon Co. Ltd., Nagoya (JP)

( * ) Notice: Subject to any disclaimer, the term of this patent is extended or adjusted under 35 U.S.C. 154(b) by 310 days.

(21) Appl. No.: 11/780,994

(22) Filed: Jul. 20, 2007

(65) Prior Publication Data

US 2008/0011619 A1 Jan. 17, 2008

Related U.S. Application Data

(60) Continuation-in-part of application No. 11/404,200, filed on Apr. 13, 2006, which is a division of application No. 10/789,961, filed on Feb. 27, 2004, now Pat. No. 7,086,526, which is a continuation-in-part of application No. 10/781,321, filed on Feb. 17, 2004, now abandoned, which is a continuation-in-part of application No. PCT/AU02/01105, filed on Aug. 7, 2002.

(60) Provisional application No. 60/832,324, filed on Jul. 21, 2006.

(51) Int. Cl.
*A45C 11/04* (2006.01)

(52) U.S. Cl. ..... 206/5.1

(58) Field of Classification Search ..... 206/5.1; 15/104.92, 104.93, 214; 134/901
See application file for complete search history.

(56) References Cited

U.S. PATENT DOCUMENTS 2,932,383 A 10/1960 Fagan
2,967,607 A 1/1961 Hollinger
3,130,823 A 4/1964 Antonious
3,344,461 A 10/1967 Floor
3,369,656 A 2/1968 Skinner, Jr.
3,378,020 A 4/1968 Grabiel
3,379,020 A 4/1968 Pennell
3,379,200 A 4/1968 Pennell
3,536,082 A 10/1970 Kolbeck
3,977,517 A 8/1976 Kadlecik et al.
4,113,088 A 9/1978 Binkhorst
4,150,744 A 4/1979 Fennimore
4,173,281 A 11/1979 Trought
4,257,521 A 3/1981 Poler
4,266,692 A 5/1981 Clark
4,392,569 A 7/1983 Shoup
4,423,809 A 1/1984 Mazzocco
4,597,244 A 7/1986 Pharo
4,691,820 A 9/1987 Martinez
4,710,023 A 12/1987 Loveridge
4,765,482 A 8/1988 Delia
4,769,261 A 9/1988 Hazelton et al.

(Continued)

FOREIGN PATENT DOCUMENTS

AU 62951 5/1975

(Continued)

*Primary Examiner*—Luan K Bui
(74) *Attorney, Agent, or Firm*—Holland & Hart LLP

(57) ABSTRACT

A contact lens package includes a substrate, a first sheet removably sealed to one side of the substrate, and a second sheet sealed to the other side of the substrate with a contact lens contained between the first and second sheets.

10 Claims, 18 Drawing Sheets

U.S. PATENT DOCUMENTS

| | | | | |
|---|---|---|---|---|
| 4,782,942 | A | 11/1988 | Ashley et al. | |
| 4,796,751 | A | 1/1989 | Madkour | |
| 4,865,186 | A | 9/1989 | Gates | |
| 4,909,382 | A | 3/1990 | Cuppari | |
| 5,053,208 | A | 10/1991 | Seamons et al. | |
| 5,054,610 | A | 10/1991 | Ajello | |
| 5,143,660 | A | 9/1992 | Hamilton et al. | |
| 5,176,686 | A | 1/1993 | Poley | |
| 5,337,888 | A | 8/1994 | Morrison | |
| 5,375,698 | A | 12/1994 | Ewart et al. | |
| 5,409,104 | A | 4/1995 | Lovell | |
| 5,433,314 | A | 7/1995 | Lin | |
| 5,439,572 | A | 8/1995 | Pankow | |
| 5,467,868 | A | 11/1995 | Abrams et al. | |
| 5,474,169 | A | 12/1995 | Bauman | |
| 5,515,964 | A | 5/1996 | Bauman | |
| 5,524,419 | A | 6/1996 | Shannon | |
| 5,573,108 | A | 11/1996 | Hamilton et al. | |
| 5,578,331 | A | 11/1996 | Martin et al. | |
| 5,598,601 | A * | 2/1997 | Eaton et al. | 15/214 |
| 5,598,919 | A | 2/1997 | Taylor | |
| 5,609,246 | A | 3/1997 | Borghorst et al. | |
| 5,620,087 | A | 4/1997 | Martin et al. | |
| 5,620,088 | A | 4/1997 | Martin et al. | |
| 5,630,308 | A | 5/1997 | Guckenberger | |
| D380,898 | S | 7/1997 | Lovell | |
| 5,649,410 | A | 7/1997 | Martin et al. | |
| 5,657,506 | A | 8/1997 | Pankow | |
| 5,685,420 | A | 11/1997 | Martin et al. | |
| 5,695,049 | A | 12/1997 | Bauman | |
| 5,697,495 | A | 12/1997 | Abrams et al. | |
| 5,704,468 | A | 1/1998 | Lust et al. | |
| 5,711,416 | A | 1/1998 | Bauman | |
| 5,722,536 | A | 3/1998 | Pierce et al. | |
| 5,772,014 | A | 6/1998 | Jacober | |
| 5,823,327 | A | 10/1998 | Wu et al. | |
| 5,839,587 | A | 11/1998 | Gress et al. | |
| D401,762 | S | 12/1998 | Abrams et al. | |
| 5,853,085 | A | 12/1998 | Luttrell | |
| 5,881,867 | A | 3/1999 | Tohill, Jr. et al. | |
| 5,915,545 | A | 6/1999 | Shackel et al. | |
| 5,983,608 | A | 11/1999 | Wu et al. | |
| 6,029,808 | A | 2/2000 | Peck et al. | |
| 6,044,966 | A | 4/2000 | Haase | |
| 6,047,938 | A | 4/2000 | Mitchell | |
| 6,050,398 | A | 4/2000 | Wilde et al. | |
| 6,082,533 | A | 7/2000 | Smith et al. | |
| 6,092,646 | A | 7/2000 | Glazier | |
| 6,134,736 | A | 10/2000 | Pankow | |
| 6,138,312 | A | 10/2000 | Cummings | |
| 6,161,696 | A | 12/2000 | Lashley | |
| 6,164,452 | A | 12/2000 | Ellis | |
| 6,244,430 | B1 | 6/2001 | Travis | |
| 6,253,912 | B1 | 7/2001 | O'Neill et al. | |
| 6,260,695 | B1 | 7/2001 | Tasber et al. | |
| RE37,558 | E | 2/2002 | Abrams et al. | |
| 6,364,098 | B2 | 4/2002 | Yavitz | |
| 6,382,408 | B1 | 5/2002 | Bruun-Jensen | |
| 6,401,915 | B1 | 6/2002 | Faxe | |
| 6,474,465 | B1 | 11/2002 | Jux | |
| 6,558,420 | B2 | 5/2003 | Green | |
| 2001/0017271 | A1 | 8/2001 | Yavitz | |
| 2002/0020634 | A1 | 2/2002 | Fortune | |
| 2002/0029984 | A1 | 3/2002 | Hughes | |
| 2002/0063068 | A1 | 5/2002 | Faxe et al. | |
| 2002/0175177 | A1 | 11/2002 | Jepson | |
| 2003/0024829 | A1 * | 2/2003 | Matsuzawa et al. | 206/5.1 |
| 2004/0004008 | A1 | 1/2004 | Peck et al. | |
| 2004/0238380 | A1 | 12/2004 | Newman | |
| 2006/0054514 | A1 | 3/2006 | Tokarski et al. | |
| 2006/0213783 | A1 | 9/2006 | Tokarski et al. | |
| 2007/0034533 | A1 * | 2/2007 | Coldrey et al. | 206/5.1 |
| 2007/0056861 | A1 | 3/2007 | Duis et al. | |
| 2007/0089998 | A1 | 4/2007 | Tokarski et al. | |

FOREIGN PATENT DOCUMENTS

| | | | |
|---|---|---|---|
| CN | 2384905 | Y | 6/2000 |
| DE | 836170 | C | 4/1952 |
| DE | 19525615 | A1 | 1/1997 |
| DE | 19634683 | A1 | 3/1998 |
| EP | 0 129 388 | A2 | 12/1984 |
| EP | 0389418 | B1 | 1/1993 |
| EP | 0223581 | B1 | 5/1993 |
| EP | 0734957 | A1 | 10/1996 |
| EP | 0765741 | A | 4/1997 |
| EP | 0995688 | A1 | 4/2000 |
| EP | 1092645 | A1 | 10/2000 |
| EP | 1277416 | A2 | 1/2003 |
| EP | 1 092 645 | B1 | 3/2004 |
| EP | 1028680 | B1 | 8/2004 |
| FR | 377888 | A | 9/1907 |
| FR | 2 638 248 | | 4/1990 |
| GB | 2 222 816 | A | 3/1990 |
| JP | 56-103487 | U | 8/1981 |
| JP | 06-092388 | | 4/1994 |
| JP | 06-258603 | | 9/1994 |
| JP | 10-313928 | | 5/1997 |
| JP | 09-175575 | | 7/1997 |
| JP | 10-010477 | | 1/1998 |
| JP | 2000-007020 | | 1/2000 |
| JP | 2000-502310 | | 2/2000 |
| JP | 2001-046134 | | 2/2001 |
| JP | 2001-255499 | | 9/2001 |
| JP | 2001-270580 | A | 10/2001 |
| JP | 2002-306227 | | 10/2002 |
| WO | 92/00151 | | 1/1992 |
| WO | WO 97/18997 | | 5/1997 |
| WO | 97/24022 | | 7/1997 |
| WO | WO 99/11529 | A | 3/1999 |
| WO | WO 99/21519 | | 5/1999 |
| WO | WO 00/76881 | A1 | 12/2000 |
| WO | WO 01/97726 | A | 12/2001 |
| WO | WO 03/016175 | | 2/2003 |
| WO | WO 03016175 | A1 | 2/2003 |
| WO | WO 2004/024573 | A2 | 3/2004 |
| WO | WO 2005/025991 | A2 | 3/2005 |
| WO | 2006/102384 | | 9/2006 |
| WO | 2007/047594 | | 4/2007 |
| WO | 2007/199832 | | 8/2007 |
| WO | 2008/044145 | | 4/2008 |

* cited by examiner

DUO PACKAGING FOR DISPOSABLE SOFT CONTACT LENSES USING A SUBSTRATE

RELATED APPLICATION

The present application claims the benefit under 35 U.S.C. §119(e) of U.S. Provisional Patent Application No. 60/832,324 filed Jul. 21, 2006 titled "DUO PACKAGING FOR DISPOSABLE SOFT CONTACT LENSES USING A SUBSTRATE", and is a Continuation-in-Part of U.S. patent application Ser. No. 11/404,200, filed Apr. 13, 2006 titled "Duo Packaging for Disposable Soft Contact Lenses Using a Substrate", pending, which was a Divisional Application of U.S. patent application Ser. No. 10/789,961 now U.S. Pat. No. 7,086,526, filed Feb. 27, 2004, which is a Continuation-in-Part of patent application Ser. No. 10/781,321, filed Feb. 17, 2004 now abandoned which is a Continuation-in-Part of Patent Application No. PCT/AU02/01105 filed Aug. 7, 2002. All of these applications are hereby incorporated by reference in their respective entireties.

BACKGROUND

Soft disposable contact lenses are commonly contained in disposable packages. As packaging adds to the overall cost of the lens, it should be made as economically as possible but without compromise to the requisite packaging criteria. The traditional blister pack packaging (shown in FIGS. 1-3) for disposable lenses (both bi-weekly and daily) consists of a polypropylene receptacle for the lens (herein after referred to as a "boat"), topped by a multi-layer film including polyethylene, aluminum, a bonding agent and polypropylene. The boat is typically an injection molded plastic which has high stiffness but is capable of limited elastic deflection and includes a preformed recess. The boat is filled with a suitable storage solution, preferably saline, and receives a single lens in situ. The blister pack is then autoclaved using steam and pressure to terminal sterility. These blister packs are presented to the patient in boxes of individual packs (FIGS. 4-5) or as multiple blister strips.

The marketing objective is to present the contact lens to a patient in an aesthetically pleasing package that both satisfies the statutory requirements for sterility and stability, and allows the patient to remove the lens safely and easily. The packaging is used only once and is discarded after the lens is removed. This impacts the costs of the lens/package combination. In order to reduce the overall price of the lens to the patient, the cost of the packaging should be kept to an absolute minimum. In addition, disposability of lens packages necessitates conformity with ecological standards.

The lens must be kept hydrated while in the package. Consequently, the package must be well sealed and should minimize water vapor transmission through the boat and laminated layer to maximize the shelf life and prevent dehydration of the lens contained therein. During use, the user removes the laminated material from a flange formed on the boat by peeling back the cover to expose the lens immersed in a hydrating solution.

There is a long felt need in the disposable contact lens industry to provide an economic, space-efficient, and convenient, disposable contact lens package without compromise to durability, sterility, and utility of the lens.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
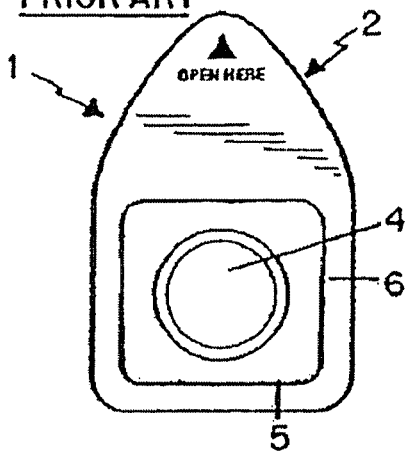
FIG. 1 PRIOR ART
FIG. 1 is a plan view of a typical prior art disposable blister contact lens package.

The present specification provides an economical package without compromise to statutory and medical requirements of contact lens packages and other objects mandated to be stored in a sterile environment. Particularly, the exemplary single-use package, in the embodiments described below, offers a number of advantages over the prior art blister pack concept. First, the present exemplary single-use package is smaller and slimmer than traditional blister packs, which lends itself to disposability and is ideal for traveling. Additionally, the number of packages in a secondary container may be increased, yet storage space for that secondary package may be reduced. For ease of explanation only, the present packaging configuration will be described in the context of a single use package for packaging contact lenses. However, the present systems and methods may be used to form a packaging for any desired object that could be stored in a sterile environment including, but in no way limited to, intraocular implants, onlays, sutures, medical implants, medical instruments, dental implants, dental equipment, and the like.

Further, the present exemplary economical package may be designed to incorporate any number of materials, colors, and/or surface finishes while still conforming to statutory medical device requirements.

The present exemplary single-use package may be include foil sheets attached to either side of a substrate which minimize light exposure and prevent oxygen transmission. Further, according to one exemplary embodiment, there is no air in the package, thus ballasted autoclaving is not required. The absence of air in the exemplary package contributes to lens stability in the package. Thus, the shelf-life of a contact lens in a single-use package may be extended. Overall, the present exemplary single-use package is a more convenient and cost effective form of packaging compared to traditional blister packs.

As alluded to previously, conventional contact lens packages are typically stiff and preformed with a profiled recess to house the lens therein. The preformed recess in the conventional packages is intended to ensure that the lens shape is maintained and is not deformed by the package. According to one exemplary embodiment, a contact lens package disclosed herein does not maintain the lens in an equilibrated position, but instead holds the lens in a flattened or compressed state.

According to another exemplary embodiment, the internal depth of a contact lens package may be less than the overall natural sagittal depth of the contact lens contained therein. Further, according to one exemplary embodiment, the exemplary single-use package may be flexible and not preformed, and may actually contribute to adjustments to the shape of the lens in the package.

Additionally, exemplary contact lens packaging disclosed herein may vary in stiffness. More particularly, stiffness of the contact lens package was previously thought essential to protect the lens. However, if wall stiffness is abandoned as an essential packaging criterion, alternative contact lens packages with significant space economy may be contemplated.

In one exemplary embodiment, a contact lens package includes a package with a contact lens therein, wherein the package has an internal depth which is less than an overall sagittal depth of the contact lens when the contact lens is in its equilibrated form.

In an additional exemplary embodiment, a method of forming a substrate member of a single use contact lens primary package includes forming a first portion of the substrate member with a first shot of a two shot mold and forming a second portion of the substrate member with a second shot of the two shot mold, wherein the second shot only injects homopolymer polypropylene over portions of the substrate member that will be exposed to a contact lens and/or the hydration medium stored therein.

In yet another exemplary embodiment, a contact lens package is formed by providing a substrate having a body with a front surface and a back surface, wherein the body defines a center orifice that passes from the front surface to the back surface. According to this exemplary embodiment, the contact lens package is formed by first removably adhering a top foil member to the front surface of the substrate. Then, a contact lens and a support medium are inserted into the center orifice. Once the contact lens and support medium are inserted in the center orifice, a hydration medium may be added and a back foil is then coupled to the back surface of the substrate.

An alternate embodiment of the present exemplary configuration provides a single use package for retaining a contact lens, with at least one barrier material defining an internal space for holding a contact lens; a medium in the space for maintaining lens hydration; and means to enable release of the lens from the space; where at least one barrier layer is formed from a homogenous, pliable material.

In an additional embodiment, a single-use package capable of holding a contact lens is provided. The package has two sheets of material; and a support member between the two sheets of material. The two sheets of material are sealed on opposing sides of the support member to define a contact lens orifice. A contact lens can be compressed or otherwise confined in the package such that the lens is always maintained in a consistent orientation inside the contact lens orifice. According to one exemplary embodiment, the lens is maintained with its outer surface oriented toward the top sealing material. This arrangement ensures the lens will be presented to the wearer in the correct configuration for easy removal and insertion into the eye.

Another exemplary embodiment includes a single-use package with a contact lens therein. The package includes two sheets of material sealed on each side of a substrate defining an orifice, a restoring member in the form of a spring disc or a sponge disc and an amount of hydration medium is disposed between the sheets in the orifice. According to this exemplary embodiment, the lens is maintained in a flattened state while the package is sealed.

A package for contact lenses and a method for manufacturing the contact lens packaging are described in detail below. More specifically, a package with a substrate having a sheet on both the top and bottom surfaces is disclosed herein. According to one exemplary embodiment, the package is dimensionally smaller than traditional packages. Further, a method for manufacturing the above-mentioned package is disclosed as well as a method for providing a seal that is both easy to open and more resistant to environmental breach when compared to traditional seals.

As used in the present specification and in the appended claims, the term "sterilizable" refers generally to any material or combination of materials which may come into physical and fluid contact with a contact lens or other object contained within a finally formed package. Although polypropylene is commonly used as a sterilizable material in packages, any other material that is capable of creating a sterile environment for contact lenses, medical devices, or dental devices can be used in the present article and method as well. According to one exemplary embodiment, a sterilizable material may include any material accepted by the Food and Drug Administration (FDA) as suitable for the packaging of sterile medical devices.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 2:
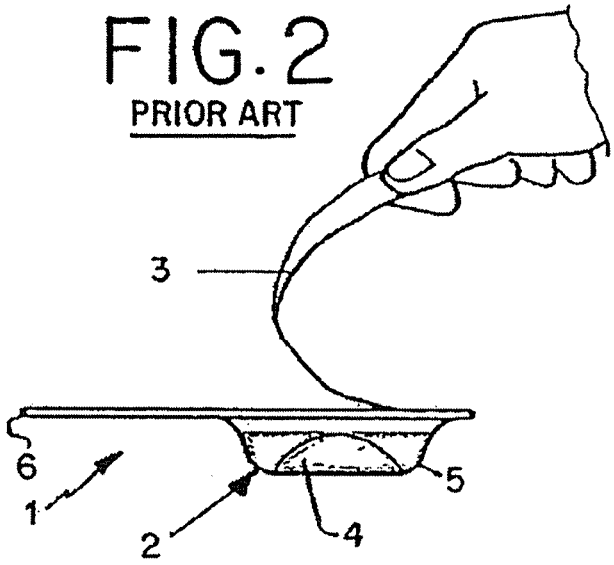
FIG. 2 PRIOR ART
FIG. 2 is a side elevation of the package of FIG. 1 with the lid peeled away to release the contact lens therein.
Figure 3:
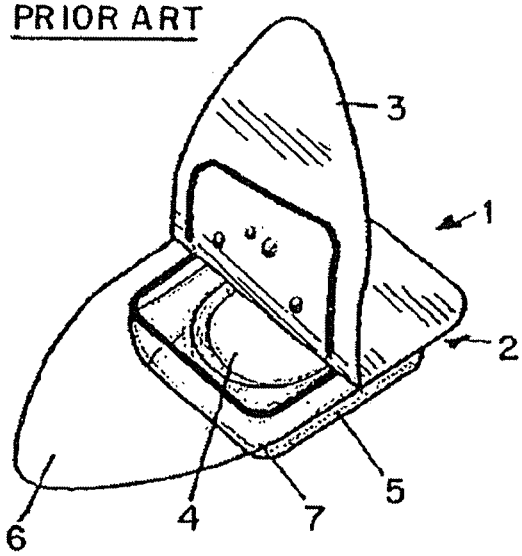
FIG. 3 PRIOR ART
FIG. 3 is a perspective view of the partially opened package of FIG. 2.

Referring to FIGS. 1 and 2, there is shown a typical prior art disposable blister contact lens package (1) which is formed in two parts. The package (1) includes a blister pack member (2) which is sealed by a membrane (3) forming a lid on the package (1) and which may be peeled away to release a contact lens (4) therein. In FIG. 3, the package of FIG. 2 is shown with the membrane (3) peeled away to expose the contact lens (4). Typically, the member (2) will be a preformed blister pack and include a profiled recess (5) which provides a recess in which a lens may be placed. The member (2) is typically injection molded and the package is completed with a sealing membrane (3) which mates with a flange (6) to create a sterile seal. The contact lens (4) is immersed in a solution (7) which keeps the lens hydrated until it is removed from the pack. The injection molded member (2) makes this an expensive package to manufacture, with the result that the contact lens will inevitably be more expensive for the consumer.

Figure 5:
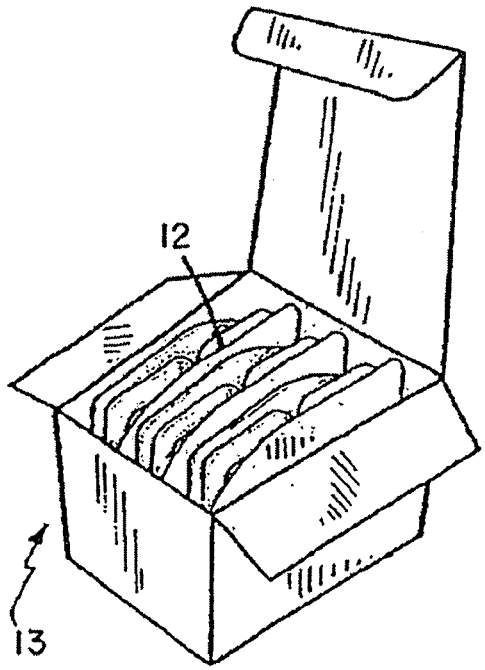
FIG. 5 PRIOR ART
FIG. 5 is a perspective view showing a plurality of blister packs stacked as in FIG. 4 and contained in a carton.
Figure 4:
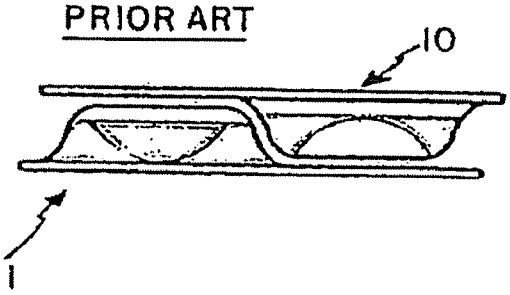
FIG. 4 PRIOR ART
FIG. 4 is a side elevation view showing a stacking arrangement for two identical prior art contact lens packages according to one embodiment.

FIG. 4 shows a stacking arrangement for two identical prior art contact lens packages (10 and 11). FIG. 4 illustrates that while two packs conveniently inter-fit, the two packs occupy a thickness greater than the thickness (or depth) of a single pack. Ideally, a lens package should occupy as little space as possible considering the relatively small size of a contact lens. Economy of storage space is an important issue where lenses are mass produced. The existing blister packs take up a disproportionate amount of space relative to the size of the lens, leading to increased handling and storage costs. FIG. 5 shows a plurality of like blister packs (12) stacked as in FIG. 4 and retained in a carton (13). This bulky, inconvenient, and materials-intensive form of lens packaging exists as a result of conventional wisdom which suggests that lenses can only be stacked in rigid containers which isolate the lens from external load.

Exemplary Articles

Figure 6:
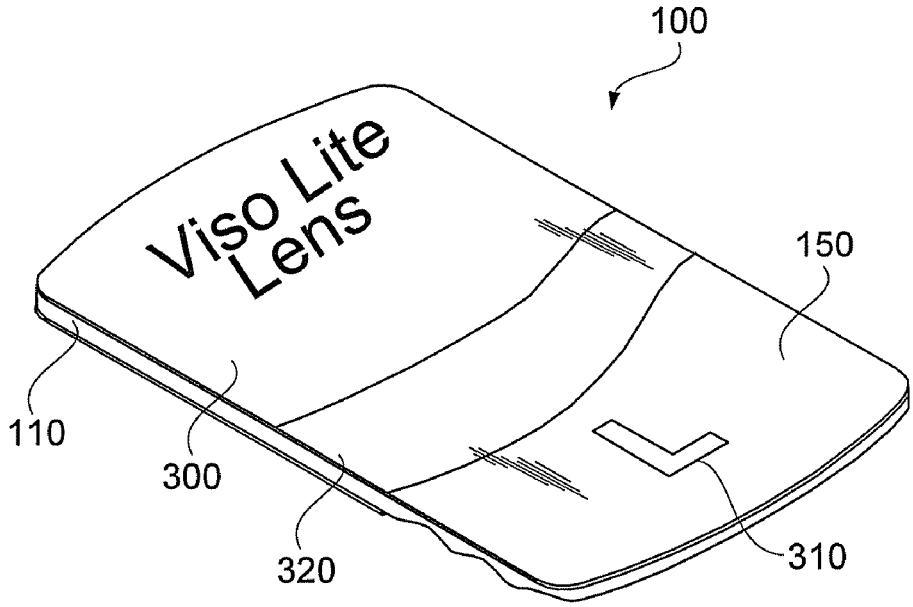
FIG. 6 is a top perspective view of a contact lens package, according to one exemplary embodiment.

FIG. 6 is a top perspective view of a contact lens package, according to one exemplary embodiment. As illustrated in FIG. 6, the present exemplary contact lens package (100) includes a center substrate (110) including a top sheet member (150) coupled to the top surface of the substrate. According to one exemplary embodiment, the top sheet member (150) is coupled to the top surface of the substrate (110) by a secure but detachable connection such that the top sheet member (150) can be separated from the substrate (110) with a constant and relatively low pulling force. Additionally, as will be described in further detail below, the top sheet member (150) is coupled to the top surface of the substrate (110) sufficient to allow the exemplary contact lens package (100) to be autoclaved. Further, FIG. 6 shows that the top sheet member (150) may contain various words and/or images including, but in no way limited to a brand name (300), a design (320), and/or information about the contact (310), for example, that it is for the left or right eye, and instructions for use.

Figure 7:
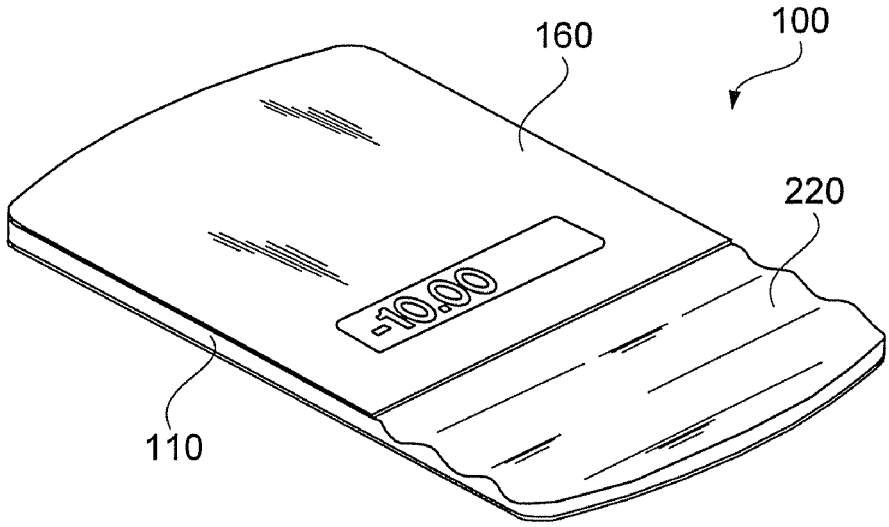
FIG. 7 is a bottom perspective view of a contact lens package, according to one exemplary embodiment.

Similarly, FIG. 7 is a bottom perspective view of the present exemplary contact lens package (100), according to one exemplary embodiment. As illustrated, a bottom sheet member (160) is coupled to the bottom surface of the substrate (110), opposite the top sheet member (150). According to the exemplary embodiment illustrated, the bottom sheet member (160) may be permanently or quite securely coupled to the bottom surface of the substrate (110). According to the exemplary embodiment illustrated in FIG. 7, the bottom sheet member (160) may be secured without thought for removal because no removable member will be accessed though removal of the bottom sheet member from the substrate. FIG. 7 also illustrates an exemplary handle end (220) or gripping surface that can be formed on the bottom surface of the substrate (110).

According to one exemplary embodiment, the exemplary top sheet (150) and the exemplary bottom sheet (160) may include a laminate foil. The exemplary laminate foil may include, but is in no way limited to, a bottom or innermost layer comprising a homogeneous material such as polypropylene to which covers at least the region of the foil that may be in physical or fluid contact with the lens. This innermost layer must be devoid of potentially toxic leachable materials. Above the inner layer may be, according to one exemplary embodiment, a layer of metal foil such as aluminum that provides strength and flexibility to the laminate. Above the aluminum layer, a top layer may be formed including a polymer, such as, but not limited to polyethylene, PET, or polyamide. According to one exemplary embodiment, the top and bottom sheets are capable of allowing the terminal sterilization of the package contents, by for example, moist heat, dry heat or gamma ray irradiation, as well as maintaining a sterile environment within the contact lens package on prolonged storage Similarly, the exemplary bottom sheet (160) may also include a laminate foil, according to one exemplary embodiment. As mentioned above, the top or innermost layer of the bottom sheet (160) which is in physical or fluid contact with the lens includes a sterilizable material. The bottom sheet (160) is otherwise designed to maintain the integrity of the packaging during handling, and may comprise the same layers as the top sheet (150), as mentioned above. As mentioned, the bottom sheet (160) will not typically be opened and thus may be permanently attached to the substrate (110), such as through a high temperature heat seal or other substantially permanent coupling. In an exemplary embodiment, the laminate foil forming the bottom sheet (160) is shorter in length than the substrate (110) such that the bottom sheet covers and is attached to body end of the substrate, but not to the handle portion. Words and images may also be printed on the bottom foil prior to or after application to the substrate (110).

Figure 8:
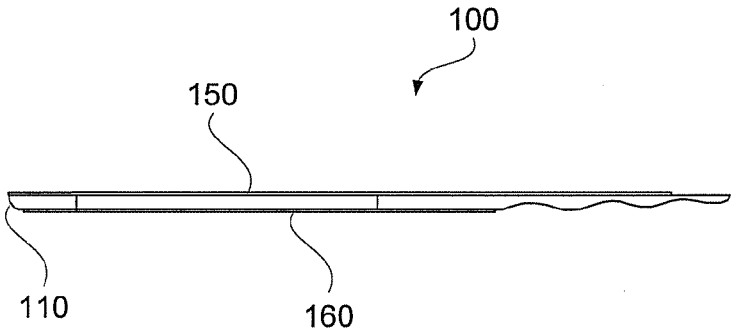
FIG. 8 is a side view of a contact lens package including a center substrate and a foil layer on a top and bottom surface of the substrate, according to one exemplary embodiment.

FIG. 8 illustrates a side view of the present exemplary contact lens package (100), according to one exemplary embodiment. As shown, a majority of the height of the present contact lens package (100) is made up of the substrate (110). FIG. 8 also illustrates the top sheet member (150) and the bottom sheet member (160) coupled on opposing sides of the substrate (110). In some exemplary embodiments, the sagittal depth of the lens (200) in a relaxed state is greater than the internal depth of the substrate defined by the center orifice (180). According to this exemplary embodiment, the lens (200) is compressed to fit inside the package (100) or by the package itself. This exemplary configuration allows for a lighter and more compact package (100). However, the present exemplary contact lens package (100) is in no way limited to a package in which the contact lens (200) is compressed therein. Rather, the present exemplary teachings and methods may be similarly incorporated in a contact lens package (100) having an internal cavity, defined by the center orifice (180), that is larger than the sagittal depth of the contact lens (200).

Figure 9:
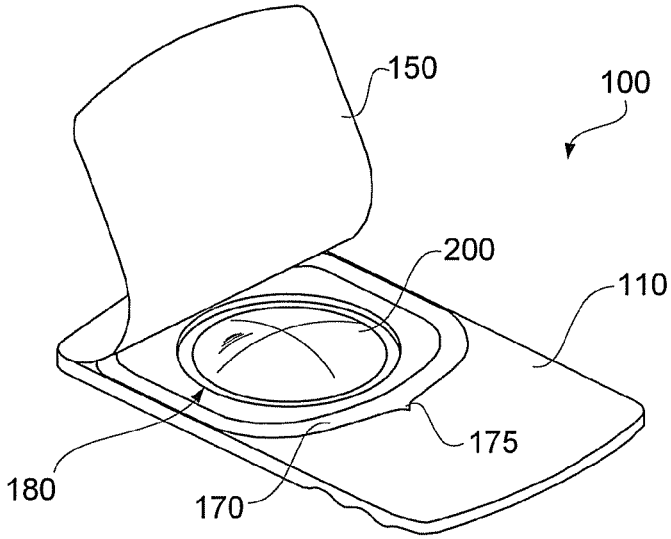
FIG. 9 is a top perspective view of a partially opened contact lens package, according to one exemplary embodiment.

FIG. 9 illustrates a top perspective view of a partially opened contact lens package, according to one exemplary embodiment. As shown in FIG. 9, the exemplary substrate (110) includes an orifice (180) defined therein. According to one exemplary embodiment, the contact lens (200) is disposed in the orifice (180) either alone or with a re-shaping member (not shown) such as a spring disc or a sponge. FIG. 9 also illustrates a seal mark (170) indicating where the top foil (150) was adhered to the top surface of the exemplary substrate (110). As shown in FIG. 9, the seal mark (170) may include a peak (175) or a point used to initiate removal of the top sheet member (150) from the substrate (110). According to one exemplary embodiment, the incorporation of the peak (175) allows the initial force imparted on the foil to be applied to a relatively small area of bonded material, thereby allowing for easy initiation of the separation of the top sheet member (150) from the substrate (110). According to one exemplary embodiment, a relatively large portion of the top sheet member (150) may be bonded to the substrate (110) thereby increasing the barrier between the atmosphere and the contact lens (200). Consequently, when compared to traditional contact lens packaging, the present exemplary contact lens packaging system (100) reduces the risk that a loss of sterility of the contact lens will occur.

Figure 10:
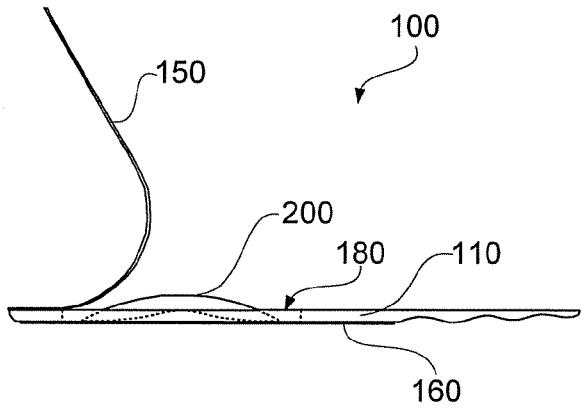
FIG. 10 is a side view of a partially opened contact lens package, according to one exemplary embodiment.

FIG. 10 further illustrates the effect of removing the top sheet member (150) from the substrate (110), according to one exemplary embodiment. As mentioned, the contact lens (200) may be compressed when positioned in the orifice (180) portion of the substrate (110) and the top sheet member (150) and the bottom sheet member (160) are sealed to the substrate. Once the top sheet member (150) is removed, the contact lens (200) may return to its natural sagittal depth. As illustrated in FIG. 10, the lens (200) may return to its natural curved shape without outside motivation. Alternatively, a spring disc or sponge member may be included in the orifice (180) to aid the lens in returning to its natural shape.

Figure 11:
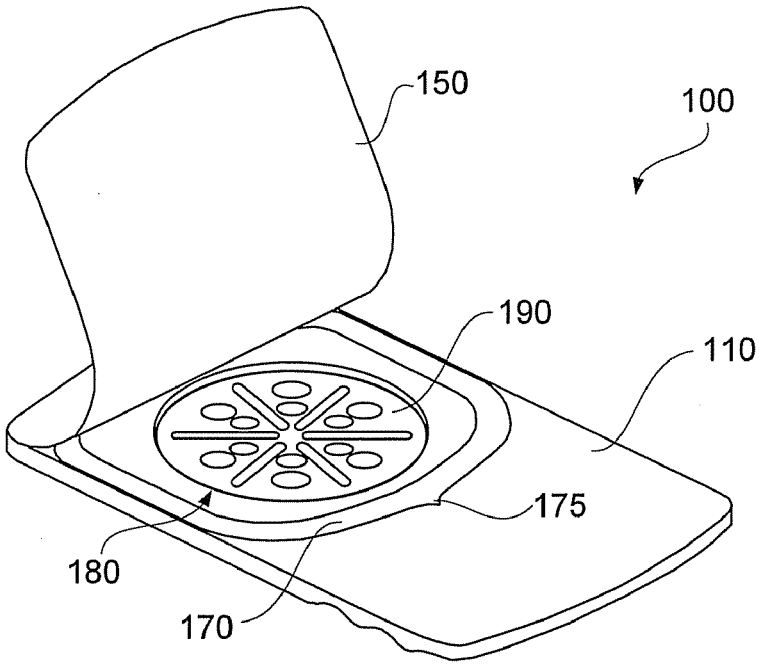
FIG. 11 is a top perspective view of a partially opened contact lens package, according to one exemplary embodiment.

FIG. 11 illustrates an exemplary contact lens packaging system (100) including a spring disc (190) disposed in the orifice (180). For clarity, the contact lens (200, FIG. 10) that rests on top of the spring disc (190) has been removed. According to one exemplary embodiment, the spring disc (190) may be positioned in the orifice (180) as an integrated portion of the substrate (110). Alternatively, the spring disc (190) may be an independent member disposed in the orifice (180) without coupling structure, thereby allowing the spring disc (190) to float within the orifice. Furthermore, the spring disc (190) may include interference features, such as a flange or other component that interacts with the substrate (110) to somewhat maintain the position of the spring disc, without being an integrated portion of the substrate.

Figure 12:
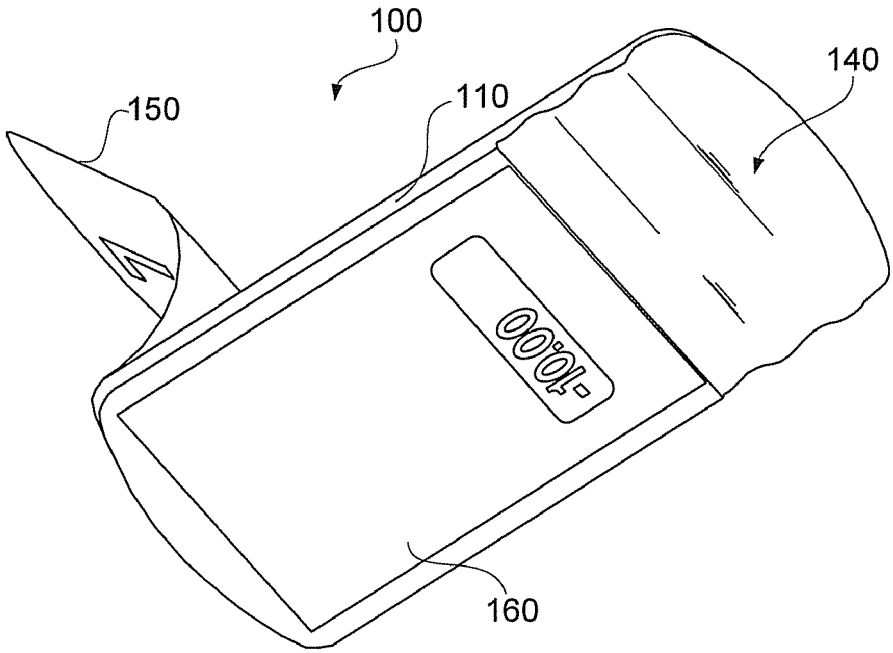
FIG. 12 is a bottom perspective view of a partially opened contact lens package, according to one exemplary embodiment.

As shown in the exemplary bottom perspective view of FIG. 12, the bottom sheet member (160) is not removed during removal of a contact lens (200, FIG. 10) from the contact lens packaging system. Rather, according to one exemplary embodiment, the bottom sheet member (160) is securely adhered to the bottom surface of the substrate (110) without access tabs or any other material that allows for the removal of the sheet member. Also illustrated in FIG. 12, the ridged grip area (140) of the substrate (110) aids in the gripping and separation of the top sheet member (150) from the substrate.

Figure 13:
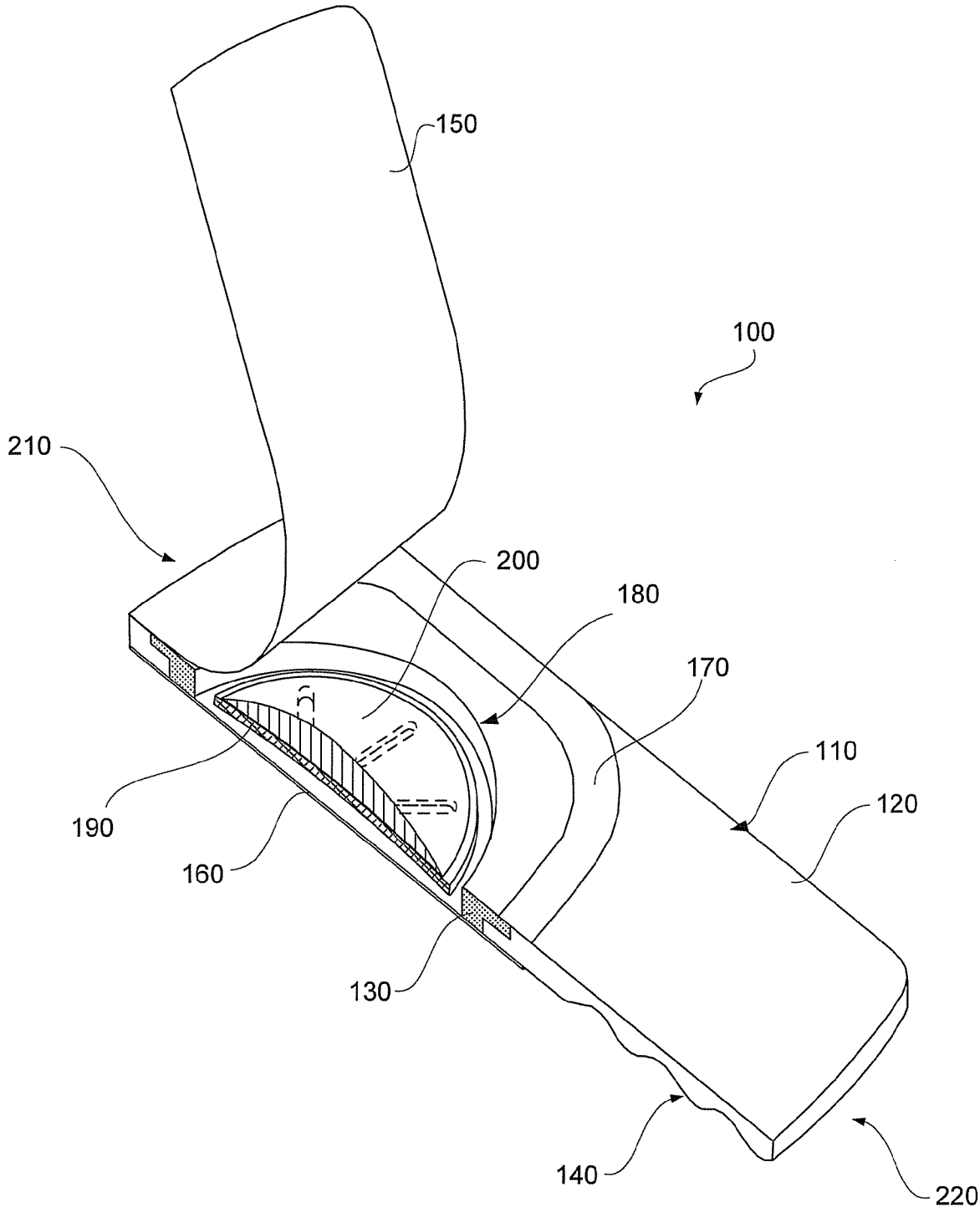
FIG. 13 is a perspective cutaway view of a partially opened contact lens package, according to one exemplary embodiment.

FIG. 13 is a perspective cutaway view of a partially opened contact lens package, according to one exemplary embodiment. As illustrated in FIG. 13, the substrate (110) defines an orifice (180) sized to receive the contact lens (200) and other packing elements. For example, according to one exemplary embodiment, a shape restoration element (190), such as a spring disc or a sponge may be present below the lens (200).

According to one exemplary embodiment illustrated in FIG. 13, the substrate (110) may be formed from a plurality of materials including a sterilizable barrier region (130) that may be exposed to the lens (200). This sterilizable barrier region (130) may include, according to one exemplary embodiment, a homogeneous material such as natural or homopolymer polypropylene to maintain the sterility of the lens following terminal sterilization. Alternatively, the sterile region (130) may be formed of any number of FDA approved sterilizable materials. According to this exemplary embodiment, the remaining portion of the substrate (110) is composed of a bulk or core material (120). The core material (120) can comprise essentially any material, as the core material (120) does not contact and is in no way exposed to the lens (200), thereby providing the ability to include any number of colors, surface finishes, stiffness, and other desired material properties from the core material (120).

Due to the fact that the core material (120) does not contact and is in no way exposed to the lens (200), sterility requirements do not constrain the choice of materials. For example, according to one exemplary embodiment, the core material (120) may include, but is in no way limited to, glass filled polypropylene, acrylonitrile butadiene styrene, polystyrene, polyethylene terepthalate, polypropylene copolymer, polymethylpentene, polycarbonate, polysulphone, polyethylene naphthalate, cyclic olefin copolymer, fluorinated ethylene propylene, etc., to achieve desired coloring, finish, shape, etc.

The packaging (100) including both a barrier material (130) and a core material (120) can be formed, according to one exemplary embodiment, though a two-shot molding process and allows for significant design flexibility. Further details of the two-shot molding process will be provided below. As illustrated in FIG. 13, the substrate includes a packaging end (210) which contains the lens (200), and a handle end (220) which can be gripped by the patient to open the packaging for use. The handle end (220) of the packaging is designed to allow for easy handling of the packaging.

Figure 14:
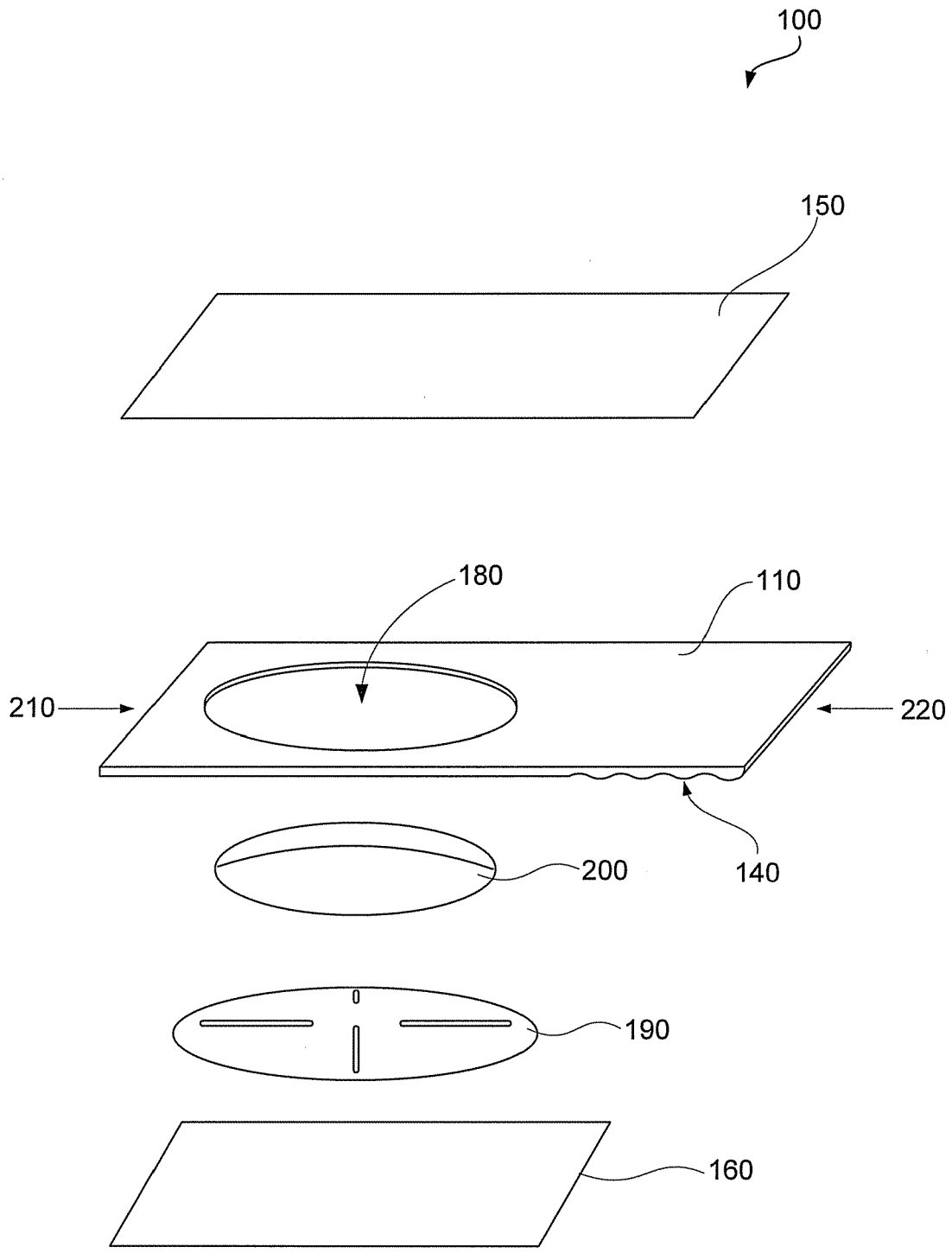
FIG. 14 is an exploded view of a contact lens package, according to one exemplary embodiment.

Turning now to FIG. 14 which illustrates an exploded view of the present exemplary contact lens package, according to one exemplary embodiment. As shown, the shape restoration member (190), which may include, but is in no way limited to, a spring disc or a sponge member, may be physically separate from the substrate (110). According to this exemplary embodiment, having the shape restoration member (190) physically separate from the substrate (110) allows for free flotation of the shape restoration member (190) within the center orifice (180). Additionally, according to one exemplary embodiment detailed below with reference to FIG. 39, manufacturing the present exemplary contact lens package (100) with the shape restoration member (190) separate from the substrate (110) allows for the rear assembly of the contact lens package and off-line pre-coupling of the top sheet member (150) to the top surface of the substrate (110).

Figure 15:
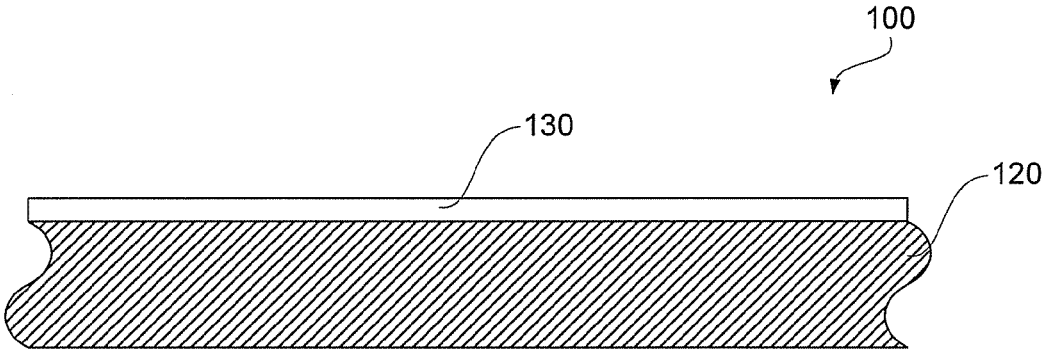
FIG. 15 is a side cross-sectional view of a contact lens package substrate formed by a two shot mold, according to one exemplary embodiment.

As mentioned previously, design flexibility, in terms of materials, colors, surface finishes, and mechanical properties, may be provided to the present exemplary contact lens package by forming both a barrier material (130) portion and a core material (120) portion, according to one exemplary embodiment, though a two-shot molding process. FIG. 15 is a side cross-sectional view of a contact lens package substrate (110) formed by a two shot mold, according to one exemplary embodiment. As illustrated in FIG. 15, the substrate (110) includes both a core material (120) and a barrier material coating (130).

According to one exemplary embodiment, the core material (120) may be formed of any number of materials including non FDA approved materials. This flexibility provides for the ability to select materials based on color, texture, material properties, cost, and the like. According to this exemplary embodiment, the core material (120) may be formed by a first shot of a two-shot molding process. Subsequent to the formation of the core material (120), the barrier material coating (130) may be formed by the second shot of the two-shot molding process. As shown, this forms a layer of the barrier material coating (130) on the core material (120). While the formation of the two-shot molded substrate (110) illustrated in FIG. 15 is described as forming the core material (120) first, followed by the forming of the barrier material coating (130), the order of operations and formation may be reversed.

According to one exemplary embodiment, the thickness of the barrier material coating (130) on the top layer of the core material (120) may be approximately, but is in no way limited to, 0.01 mm and the core material may have a thickness of approximately, but is in no way limited to, 0.70 mm. While the present substrate structure is described in the context of forming a substrate (110) for use with a top sheet member (150) and a bottom sheet member (160), the same principles and practices of using a two-shot molding method to create a core material (120) and a barrier material coating (130) may also be applied to traditional boats such as those illustrated in FIGS. 1-5.

As used herein, and in the appended claims, the term "barrier material" or "barrier material coating" are meant to be understood as any material that is non-toxic and non-leaching and may be used to form the portion of a composite packaging that contacts the lens and/or hydration medium.

Figure 16:
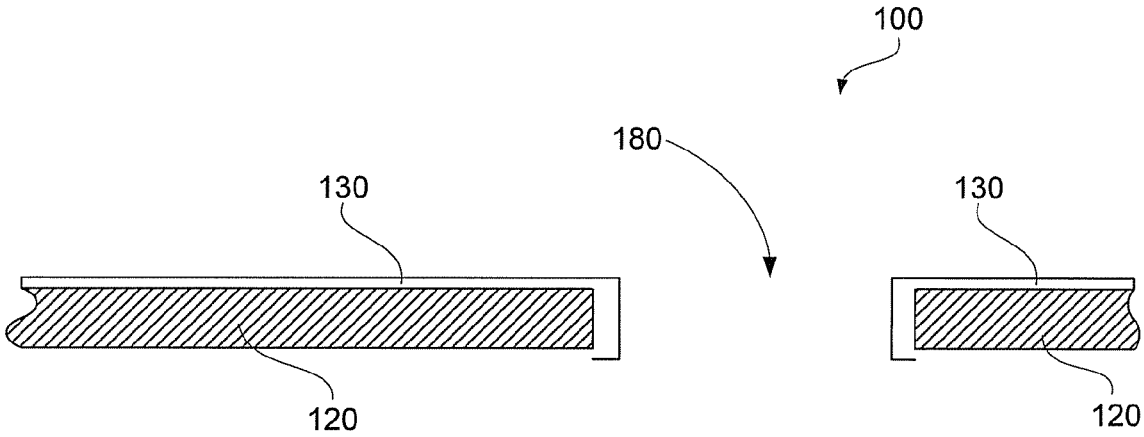
FIG. 16 is a side cross-sectional view of a contact lens substrate including a center orifice formed by a two shot mold, according to one exemplary embodiment.

In addition to coating the top layer of the substrate (110) using the two-shot molding method, the orifice (180) configured to house the contact lens (200) is also coated with the barrier material coating (130) to assure that the contact lens is not exposed to the core material (120) during manufacture or storage. FIG. 16 is a side cross-sectional view of a contact lens substrate including a center orifice formed by a two shot mold, according to one exemplary embodiment. As illustrated, the inner wall of the orifice (180) is coated with the barrier material (130) in order to assure sterility of the contact lens. As shown, a contact lens will be hermetically sealed both from the outside atmosphere and the core material (120) on each side by the barrier material (130) and on the top and bottom surfaces by the top sheet member (150) and the bottom sheet member (160), respectively. According to one exemplary embodiment, the mold used to form the barrier material (130) on the inner wall of the orifice (180) may be configured to provide a thicker layer of sterilizable barrier material, as compared to that formed on top of the core material (120), in order to assure sterility of the lens containing orifice (180). According to one exemplary embodiment, the barrier material (130) on the inner wall of the orifice (180) may vary in thickness, but is in no way limited to, a range of approximately 0.10 mm to 0.20 mm.

According to one exemplary embodiment, the core material (120) comprises the bulk of the substrate (110). The barrier material (130) is in a layer above core material (120) and surrounding the center orifice (180). The barrier material on the top of the substrate (110) may also serve to bind the top sheet member (150) to the substrate (110). For example, the top sheet member (150) may be attached to the substrate (110) by a removable heat seal between in what is commonly called an easy peel seal. The barrier material (130) may be polypropylene, and polypropylene coating the top of the substrate (110) may be bound to polypropylene on the bottom of the top sheet member (150) through a removable heat seal. The top sheet member may be attached to as large an area of the top surface of the substrate (110) as desired to form a seal that will not break or compromise the sterility of the contact lens (200). FIG. 13 illustrates a seal mark (170) on the substrate (110) wider than used in edge seals in traditional packaging. This ensures a strong seal to protect sterility. The adhesive also includes a peak (175, FIG. 12) toward the handle end (220, FIG. 13) of the packaging, which helps the consumer to start a break in the seal and pull back the top sheet member (150, FIG. 13).

Figure 17:
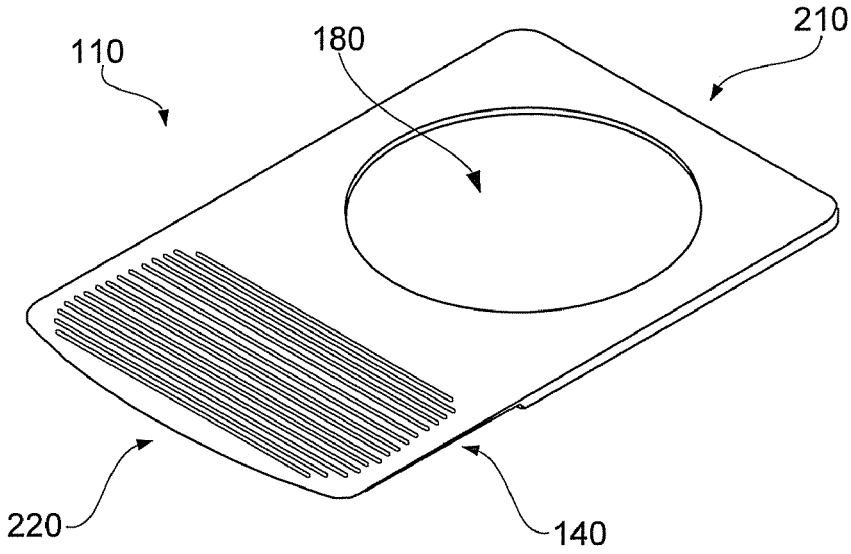
FIG. 17 is a top perspective view of a center substrate of a contact lens package, according to one exemplary embodiment.
Figure 18:
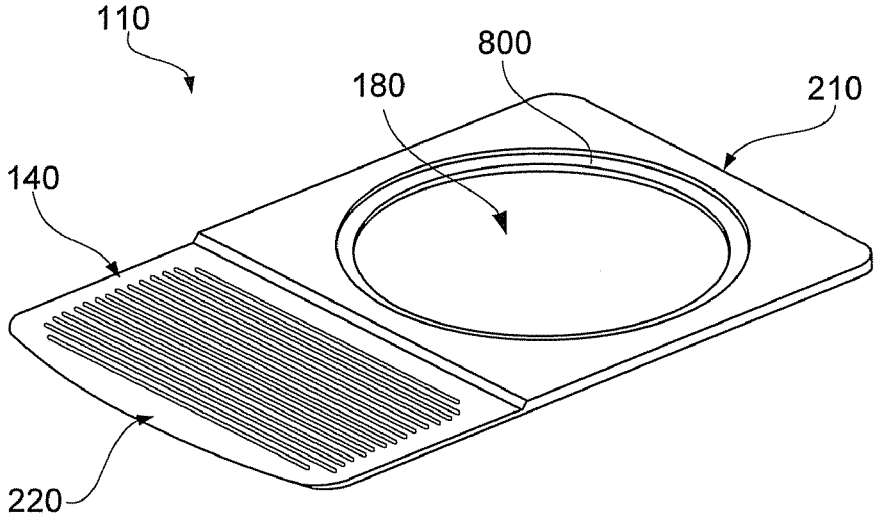
FIG. 18 is a bottom perspective view of a center substrate of a contact lens package, according to one exemplary embodiment.

Turning now to the shape and features of the substrate portion (110) of the present exemplary contact lens package (100), FIGS. 17-18 illustrate a top view and a bottom view of a center substrate (110) of a contact lens package, according to one exemplary embodiment. As illustrated in FIG. 17, the handle end (220) of the exemplary substrate (110) includes the ridged gripping surface (140) for aiding a patient in correctly griping and holding the substrate during opening of the package (100). As shown, the handle end (220) of the exemplary substrate (110) may be thinner than the packaging end (210) of the substrate. According to this exemplary embodiment, the thinner portion of the handle end (220) allows the exemplary substrate (110) to bend from the handle end (220) during opening by a patient at a greater radius than the packaging end (210). This feature aids in allowing a more secure grasp of the top sheet member (150, FIG. 14) during opening.

FIG. 18 illustrates a feature of the bottom surface of the present exemplary substrate (110). As shown, a retention seat (800) may be formed around the center orifice (180) on the bottom surface of the substrate (110). According to this exemplary embodiment, a shape restoration member (190, FIG. 14) or other feature may be sized larger than the through hole in the center orifice (180) such that the shape restoration member engages the retention seat (800) when inserted from the bottom. Once inserted in the retention seat (800), the shape restoration member (190, FIG. 14) will then be retained by the coupling of the bottom sheet member (160, FIG. 14) to the bottom surface of the substrate (110), thereby constraining the shape restoration member. According to this exemplary embodiment, the retention seat (800) prevents the shape restoration member (190, FIG. 14) from interfering with removal of the contact lens (200, FIG. 14) from the package (100, FIG. 14) after opening.

Figure 19:
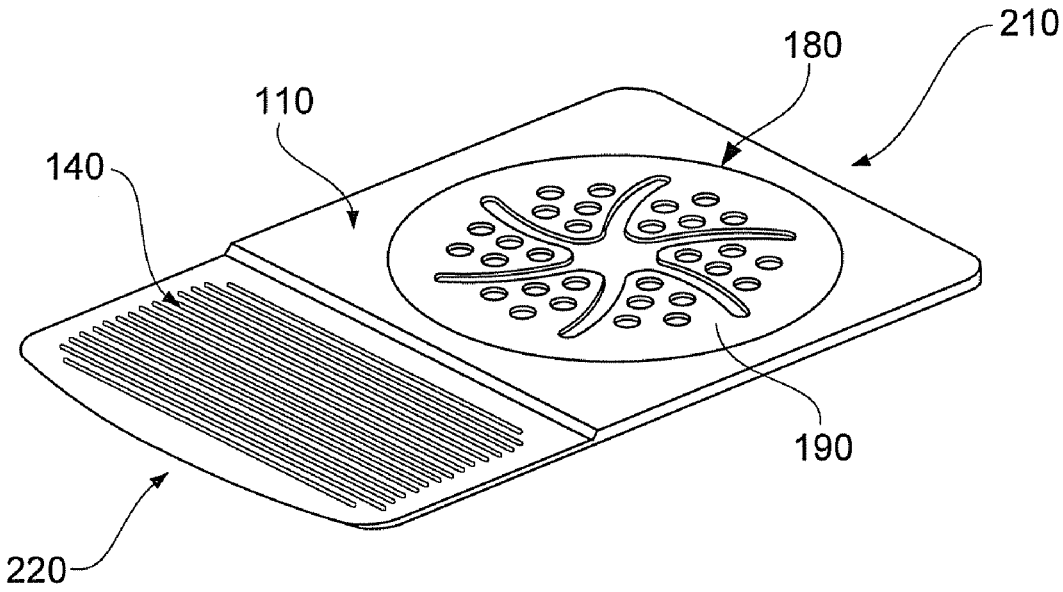
FIG. 19 is a bottom view of a center substrate of a contact lens package, according to one exemplary embodiment.
Figure 20:
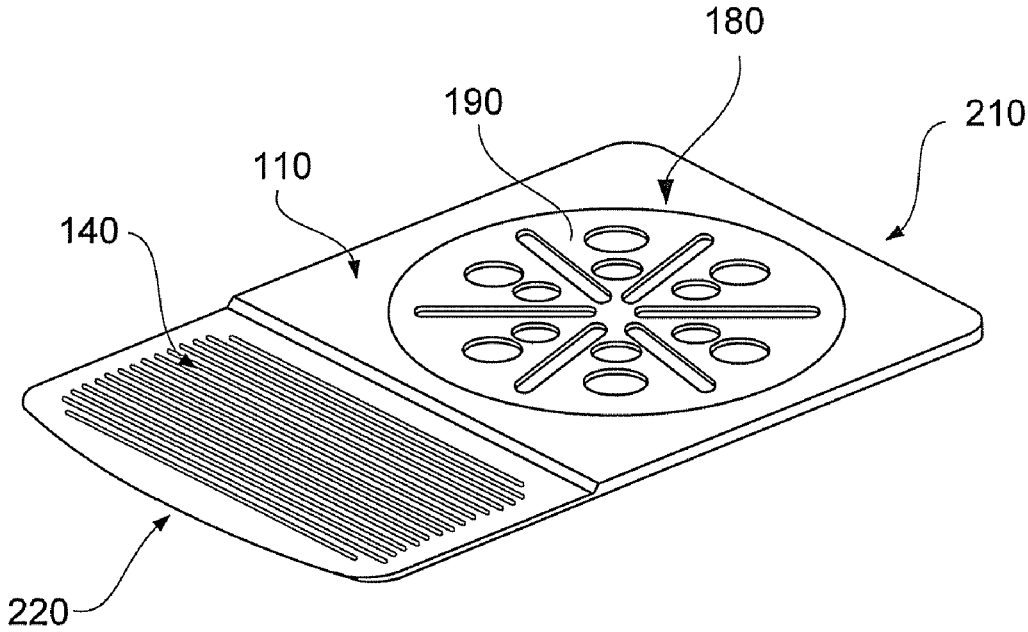
FIG. 20 is a bottom view of a center substrate of a contact lens package, according to one exemplary embodiment.

FIGS. 19 and 20 are bottom views of a center substrate (110) of a contact lens package (100, FIG. 14), according to one exemplary embodiment. In contrast to the previous substrates (110, FIGS. 17 and 18), the exemplary substrates illustrated in FIGS. 19 and 20 include the shape restoration member (190) formed as an integral portion of the substrate (110). As shown, the restoration member (190) is formed directly in the center orifice (180) where it will receive an inserted contact lens (200). According to this exemplary embodiment, the shape restoration member (190) may be formed entirely of a barrier material (130), or may alternatively be formed from a core material (120) coated by a barrier material (130), such as by a two-shot mold process. However, as shown, the shape and structure of the shape restoration member (190) may vary, as described in U.S. patent application Ser. No. 10/781,321, incorporated herein by reference in its entirety.

Figure 21:
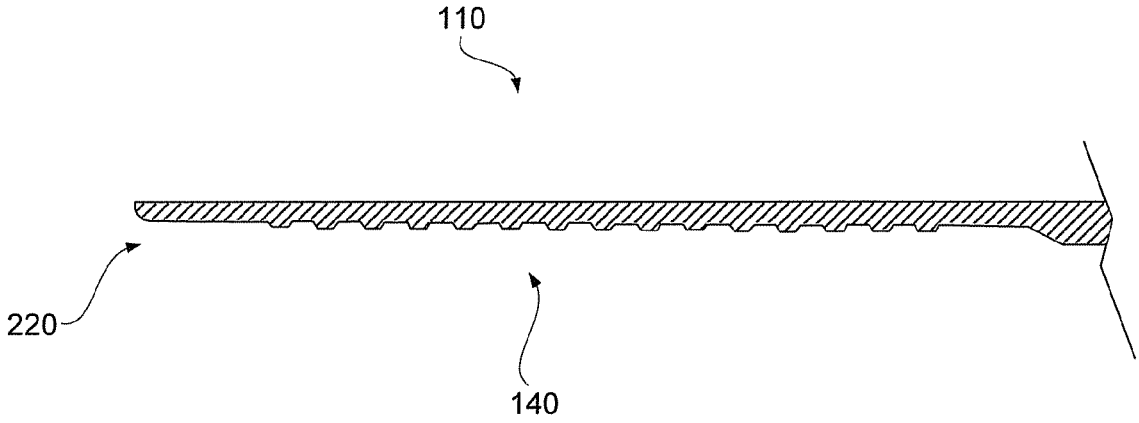
FIG. 21 is a cross sectional view of a center substrate of a contact lens package, according to one exemplary embodiment.

FIG. 21 is a side view of a gripping portion (140) of a center substrate (110) for a contact lens package (100), according to one exemplary embodiment. As shown, the gripping portion (140) formed on the handle end (220) of the substrate includes a number of ridges to increase the surface friction of the gripping portion. While the friction may be increased by the ridges formed on the gripping portion (140), any number of aesthetic and ergonometric cuts and edges may be formed on the gripping portion of the center substrate (110).

Figure 22:
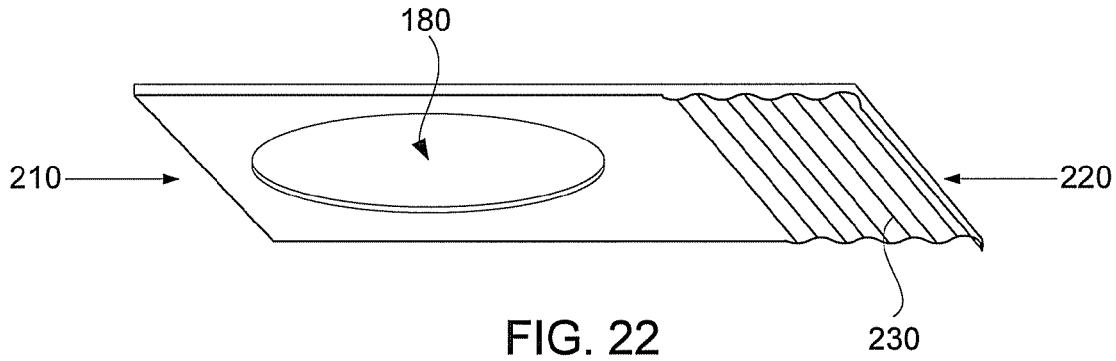
FIG. 22 is a bottom perspective view of a substrate showing ribs or ridges on the handle end, according to one exemplary embodiment.
Figure 23:
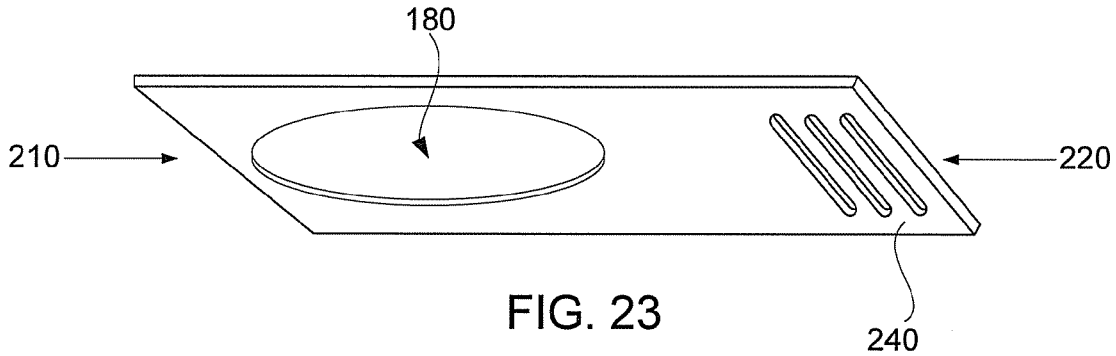
FIG. 23 is a bottom perspective view of a substrate showing apertures on the handle end, according to one exemplary embodiment.
Figure 24:
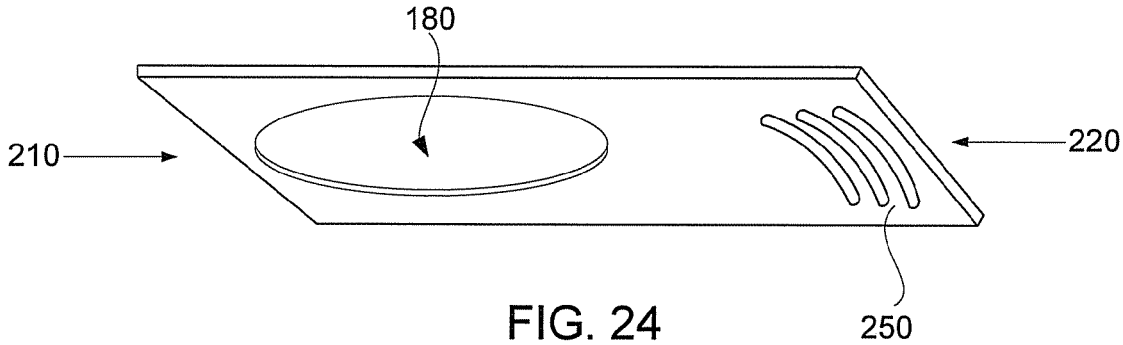
FIG. 24 is a bottom perspective view of a substrate showing gripping protrusions on the handle end, according to one exemplary embodiment.
Figure 25:
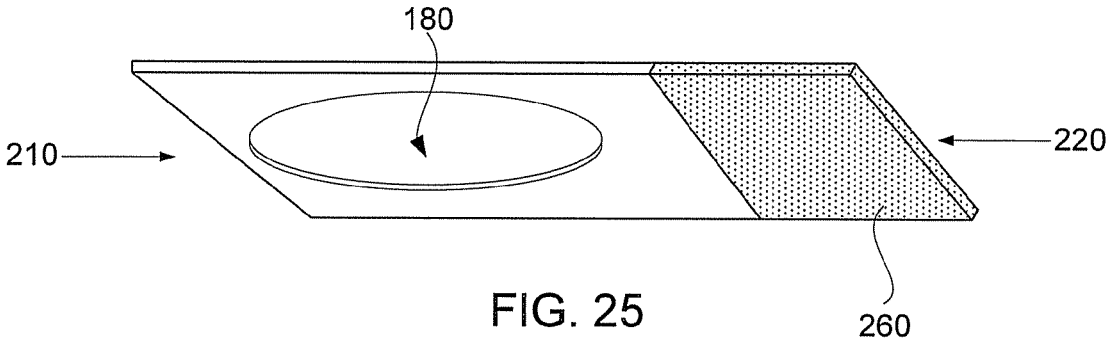
FIG. 25 is a bottom perspective view of a substrate showing a frictional surface on the handle end, according to one exemplary embodiment.

While FIG. 21 illustrates protruding ridges as being used to increase friction of the gripping portion (140), any number of configurations may be used to increase friction and provide an appropriate gripping portion (140), according to various embodiments. As illustrated in FIGS. 22-25, several exemplary easy handling design features may be formed. FIG. 22 illustrates ribs or ridges (230) on the handle end (220) of the substrate (110). FIG. 23 illustrates apertures (240) on the handle end (220) of the substrate (110). FIG. 24 illustrates gripping bars (250) on the handle end (220) of the substrate (110). FIG. 25 shows a frictional region (260), achieved by roughing or choice of a frictional material, etc., on the handle end (220) of the substrate (110). In one exemplary embodiment, the substrate (110) is about 40 millimeters long, 25 millimeters wide and 1 millimeter thick.

Figure 26:
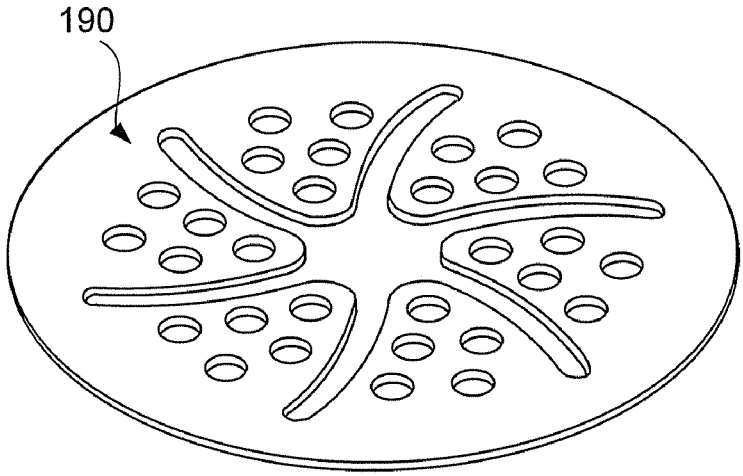
FIG. 26 is a top perspective view of a form restoration member, according to one exemplary embodiment.
Figure 27:
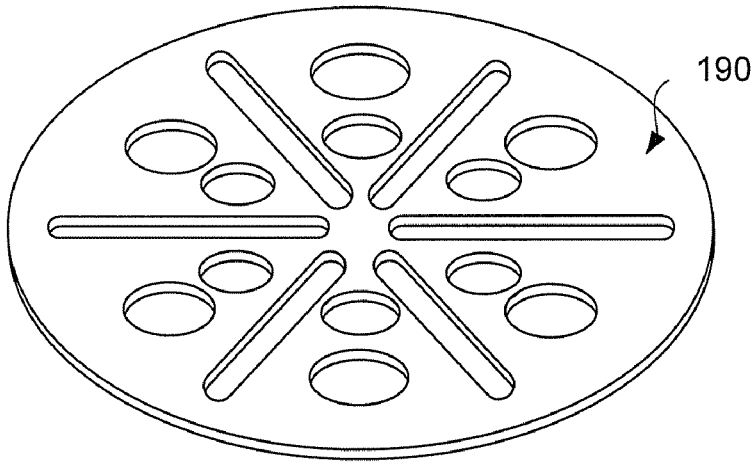
FIG. 27 is a top perspective view of a form restoration member, according to one exemplary embodiment.

As mentioned previously, the shape restoration member (190) may assume any number of shapes and structures. FIGS. 26 and 27 illustrate two exemplary spring disc structures.

Figure 28:
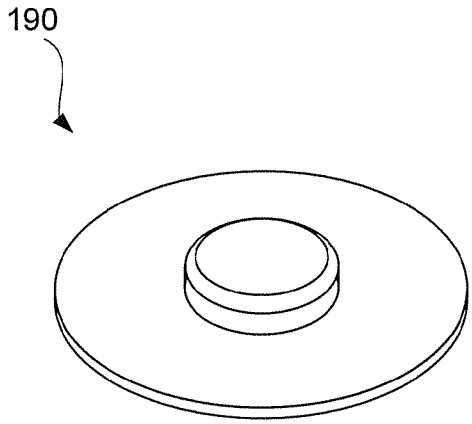
FIG. 28 is a perspective view of the top of a button foam restoration member, according to one exemplary embodiment.
Figure 29:
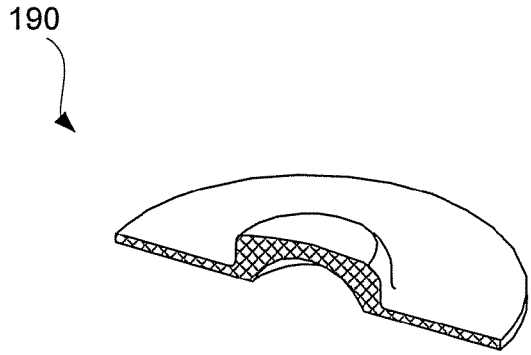
FIG. 29 is a cut-away view of a hollow button foam restoration member, according to one exemplary embodiment.
Figure 30:
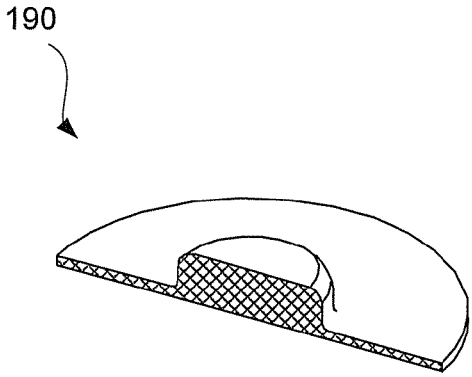
FIG. 30 is a cut-away view of a solid button foam restoration member, according to one exemplary embodiment.
Figure 31:
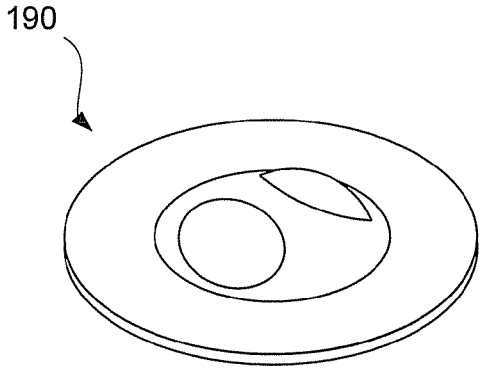
FIG. 31 is a perspective view of the top of a bi-nippled foam restoration member, according to one exemplary embodiment.
Figure 32:
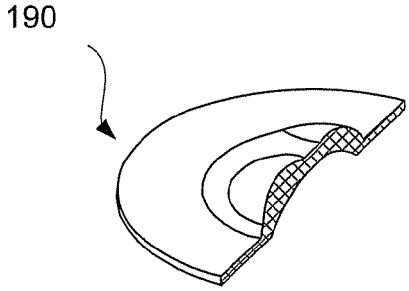
FIG. 32 is a cut-away view of a bi-nippled foam restoration member, according to one exemplary embodiment.
Figure 33:
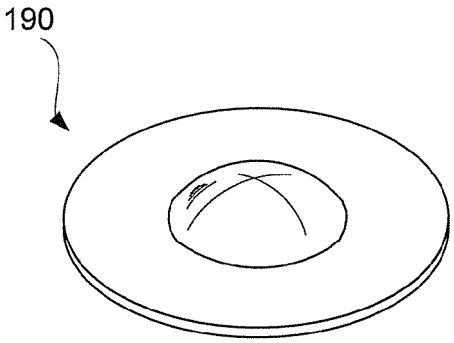
FIG. 33 is a perspective view of the top of a convex nippled foam restoration member, according to one exemplary embodiment.
Figure 34:
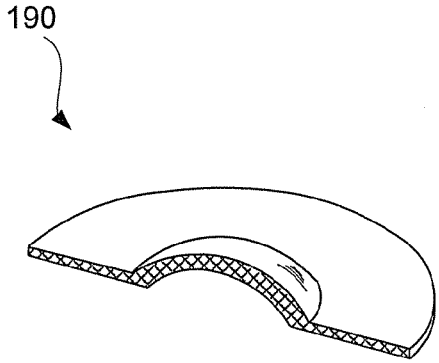
FIG. 34 is a cut away view of a hollow nipple foam restoration member, according to one exemplary embodiment.
Figure 35:
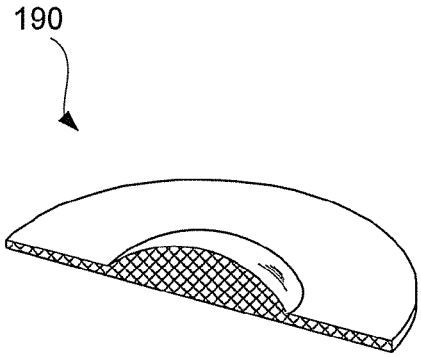
FIG. 35 is a cut-away view of a convex nippled foam restoration member, according to one exemplary embodiment.
Figure 36:
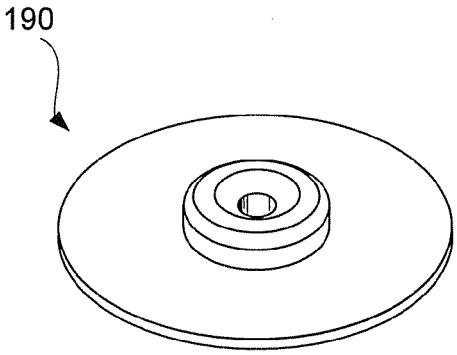
FIG. 36 is a perspective view of the top of a button shaped foam restoration member with a center cavity, according to one exemplary embodiment.
Figure 37:
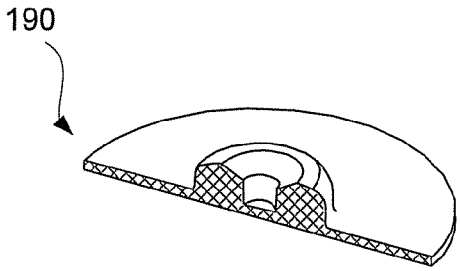
FIG. 37 is a cut away view of a button shaped foam restoration member with a center cavity, according to one exemplary embodiment.

Additionally, the shape restoration member (190) may be a foam or sponge member as illustrated in FIGS. 28-37. According to one exemplary embodiment, maintaining the shape restoration member (190) as a foam or sponge structure allows the shape restoration member (190) to be compressed with the contact lens (200) and then expand when the contact lens package (100) is opened. The use of a sponge or foam is also useful for holding fluid and aiding in the placement of the lens (200) during manufacturing. It may comprise any sterile compressible material, such as polypropylene foam, or polyvinyl alcohol foam. Said foam may have an open cell or closed cell structure. A closed cell structure may be useful to provide a strong restoring force to the lens on opening the pack, whilst a closed cell structure may serve to wick up any excess hydration medium on opening the pack. As detailed in the figures, each of the sponge or foam structures includes a specifically shaped protrusion configured to aid in the shape restoration and correct presentation of the contact lens (200, FIG. 14) when the contact lens package (100) is opened. Ideally, the contact lens would be presented with the outer surface up, so that the outer surface of contact lens may be grasped by the finger tips without contaminating the inner surface that will contact the user's eye. As shown in FIGS. 28, 29 and 30, the foam restoration member (190) may assume a button shape. The core of the button may be hollow, as shown in FIG. 29 or solid as shown in FIG. 30 according to one exemplary embodiment. FIG. 31 illustrates a bi-nippled foam restoration member, according to one exemplary embodiment. FIG. 32 shows a cross-sectional diagram of the bi-nippled foam restoration member of FIG. 31. In the embodiment in FIG. 32, the bi-nippled foam restoration member has a hollow core, but similar to the embodiments shown in FIGS. 29 and 30, the core could be solid as well. FIGS. 33, 34, and 35 illustrate a convex nippled foam restoration member, according to one exemplary embodiment. FIGS. 36 and 37 illustrate a shape restoration member configured as a button with a cavity in the center.

Exemplary Methods of Manufacturing

Figure 38:
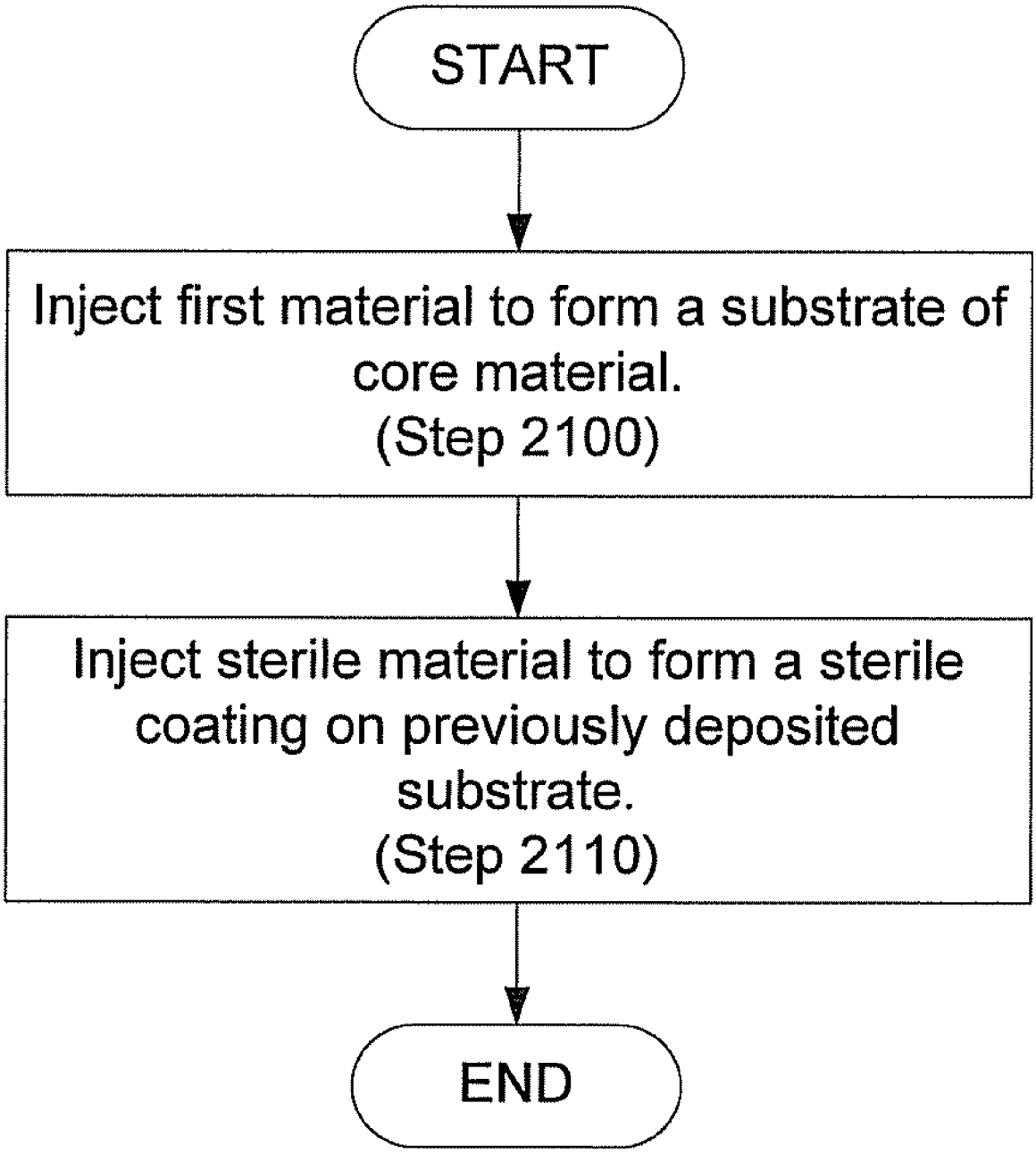
FIG. 38 is a flow chart illustrating a method for forming a contact lens packaging substrate using a two-shot mold, according to one exemplary embodiment.

According to one exemplary method, the substrate (110, FIG. 15) is manufactured to have a sterilizable barrier material overlaying a core material in at least the areas that may come into physical or fluid contact with the lens. This can be accomplished through a variety of manufacturing processes, such as the two-shot mold process. As illustrated in FIG. 38, two shot injection molding involves injecting a first core (120, FIG. 16) material into a single-cavity die (step 2100). According to one exemplary embodiment, the core material (120, FIG. 16) is formed in the shape of a desired substrate with a first shot. Once the first material has started to cool, a second material is injected (step 2110). Since the materials can be kept separate throughout the process, the sterilizable barrier material can be kept from contamination by the core material that would compromise the sterility of the package. Overmold, inlay, or any other known coating processes can also be used to create the two material substrate. The flexibility available to design the packaging (100, FIG. 15), is greatly increased, as the core material (120, FIG. 16) can be selected for any number of characteristics such as color, finish, density, strength, other mechanical properties, etc., without regard to how compatible the material is with a sterile lens environment.

Figure 39:
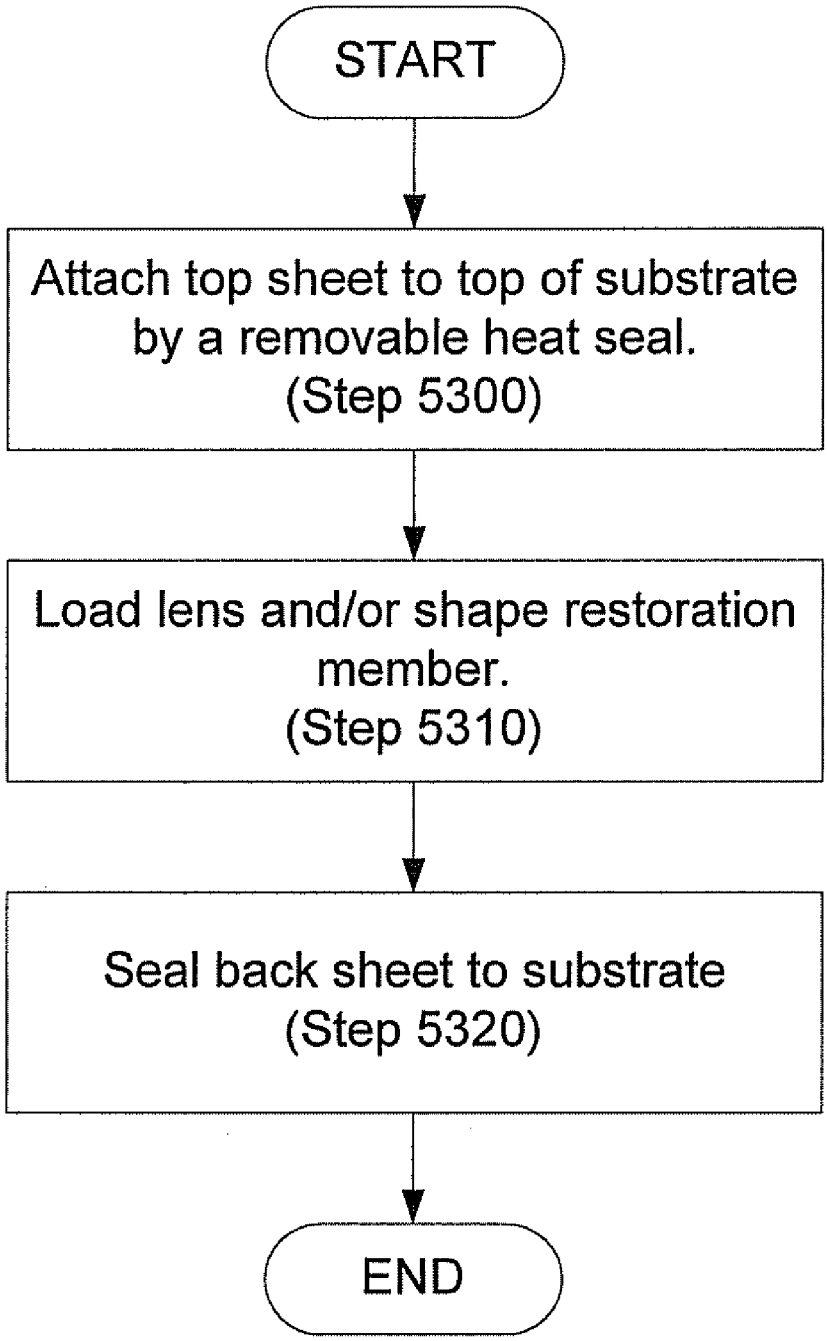
FIG. 39 is a flow chart illustrating a method for assembling a contact lens packaging having a center substrate and sealing foil on both the top and bottom surfaces, according to one exemplary embodiment.

Now referring to FIG. 39, which shows the process of assembling the lens and packaging after the substrate (110, FIG. 14) has been manufactured. The top sheet (150, FIG. 14) is then attached by a removable heat seal to top of the substrate (step 5300). According to one exemplary embodiment, the easy peel seal is formed by placing the sterilizable barrier layer of the top foil (150, FIG. 15) comprising polypropylene next to the layer of sterilizable or barrier material (120, FIG. 16)) comprising polypropylene on the top surface of the substrate (110. FIG. 16) and applying heat to the foil at the locations where the where attachment is desired, such as the region of the sealing mark (170, FIG. 11). This can be accomplished with a press having a heating region. Various other methods can also be used including, but in no way limited to, laser welding. This step is taken before the lens is in the package, and is free from constraints imposed by the presence of the lens and fluid in the package. Additionally, coupling of the top sheet (150, FIG. 15) to the substrate is typically a timely and delicate operation since the seal should be adequate to withstand autoclaving, while still providing a smooth and easy opening. According to one exemplary embodiment, the coupling of the top sheet member (150, FIG. 15) to the substrate (110, FIG. 15) may be performed off-site and be stockpiled, thereby reducing assembly time. Removable seals used in traditional packaging have a width of about 2 millimeters, and must have a strong seal that can be difficult to remove in order to maintain sterility. The exemplary method can seal the top sheet member (150, FIG. 15) to as large a portion of the substrate (110, FIG. 15) as desired to achieve a more distributed adhesion which has a stronger total seal but using a weaker local adhesion that allows the top sheet member (150, FIG. 15) to be peeled back more uniformly. Additionally, a peak (175, FIG. 11) in the seal makes the sheet easier to detach when the package (100, FIG. 13) is opened. This stage of the manufacturing can be done in advance of the loading of the lens; the substrate and attached top foil can be stored as work in progress until the manufacturer is ready to complete the process.

Once the top sheet member (150, FIG. 14) is coupled to the substrate, the lens and optional shape restoration member may be disposed in the center orifice (step 5310). According to one exemplary assembly method, the substrate (110, FIG. 14) is inverted with the top sheet member (150, FIG. 14) oriented down. A lens (200, FIG. 14) is then attached to a suction cup manufacturing arm. The arm deposits the lens (200, FIG. 14) in the center orifice (180, FIG. 14) of the substrate. Fluid may be deposited in the package before the lens is inserted, or with the lens.

Once the lens (200, FIG. 14) and the optional shape restoration member (190, FIG. 14) are inserted into the center orifice (180, FIG. 14), the bottom sheet member (160, FIG. 14) may be securely sealed to the back side of the substrate (110, FIG. 14). According to one exemplary embodiment, the back sheet member (160, FIG. 14)) is permanently attached to the substrate (110, FIG. 14) by a press or other manufacturing device. Because the back sheet member does not need to be removed, the back sheet member can be attached by full seal, a more rapid process. Because the back sheet member does not need to be removed, any appropriate adhesion process can be used to attach it, including high temperature polypropylene attachment. In the process of attaching the top sheet member (150, FIG. 14), the lens (200, FIG. 14) may be compressed, depending on the thickness of the substrate (110, FIG. 14).

According to one alternative exemplary embodiment, the bottom foil is attached to a sponge member by surface tension or otherwise. The lens (200, FIG. 14) is held below the sponge member by surface tension with fluid carried in the sponge. The bottom sheet member (160, FIG. 14) can then be attached to the substrate (110, FIG. 14), depositing and compressing the lens (200) and sponge, depending on the size of the substrate. Alternatively, a disc may be used in place of the sponge.

Because the packaging is not filled with a large quantity of saline as is common in traditional packaging, saline fluid does not squirt out of the packaging when it is opened, as commonly happens when traditional packaging is opened. Additionally, since according to various exemplary embodiments disclosed herein the lens is confined to one location and orientation and can be easily located by the consumer, the lens can be easily removed from the packaging by placing a finger on only outside surface of the lens, leaving the other side (which will rest on the eye) sterile. Thus the common occurrence in traditional packaging in which both sides of the lens are touched in an effort to find the lens in the saline fluid in the boat, or the lens is pushed up against the boat and may touch the un-sterile upper rim of the boat is avoided. The present exemplary system and method also facilitates orientation and placement of the lens on the finger for insertion on to the eye when compared to traditional packaging, where the lens may be floating in various orientations in the boat.

Figure 40:
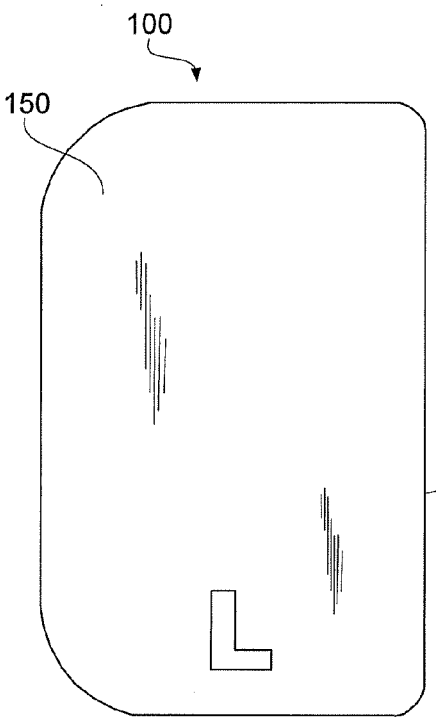
FIG. 40 is a top view of a contact lens package shape including a substantially flat side configured for ease in packaging, according to one exemplary embodiment.
Figure 41:
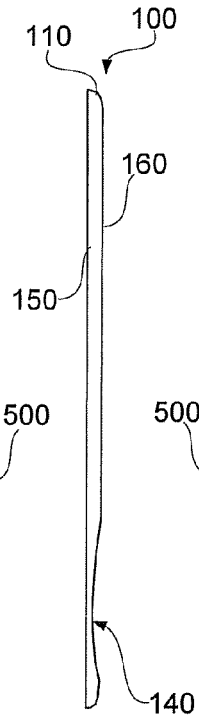
FIG. 41 is a side view of a contact lens package shape including a substantially flat side configured for ease in packaging, according to one exemplary embodiment.
Figure 42:
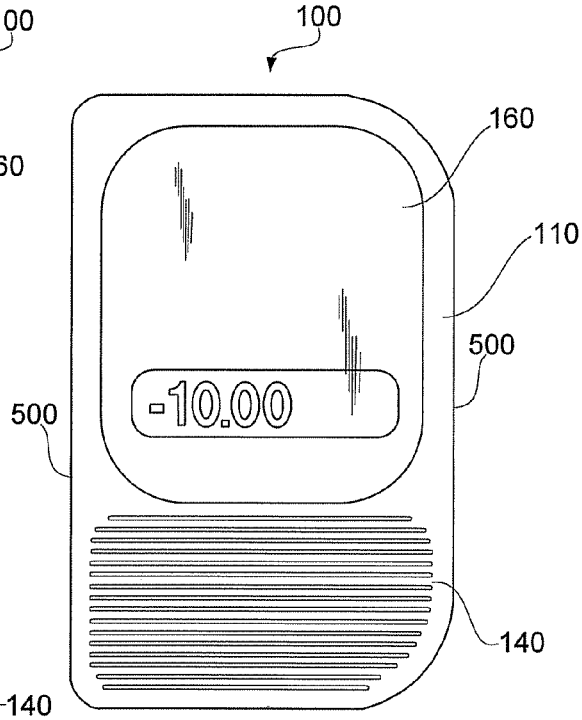
FIG. 42 is a bottom view of a contact lens package shape including a substantially flat side configured for ease in packaging, according to one exemplary embodiment.

In addition to the above-illustrated symmetrical designs, the present exemplary package (100, FIG. 14) may be formed in any shape or configuration in order to correspond to a secondary package. According to one exemplary embodiment illustrated in FIGS. 40, 41, and 42, one side (500) of the package (100), including the substrate (110) and the top sheet member (150) is substantially linear in order to accommodate a linear wall of a secondary package.

Figure 43:
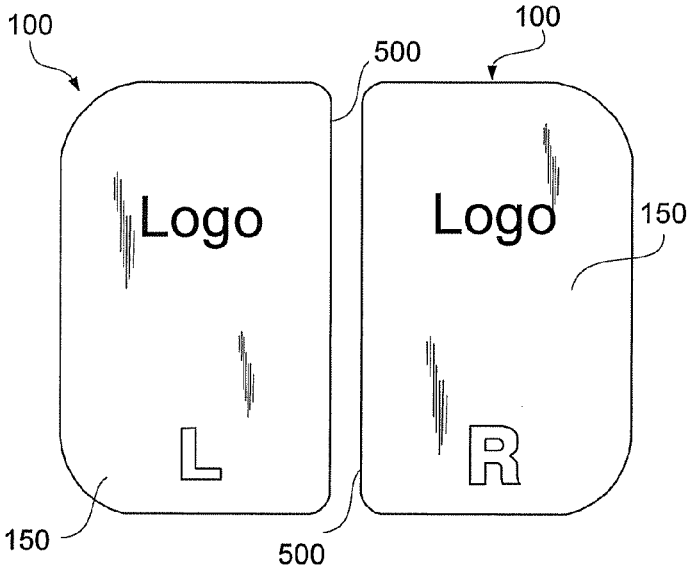
FIG. 43 is a top view of a plurality of contact lens packages including a substantially flat side configured for ease in packaging, according to one exemplary embodiment.
Figure 44:
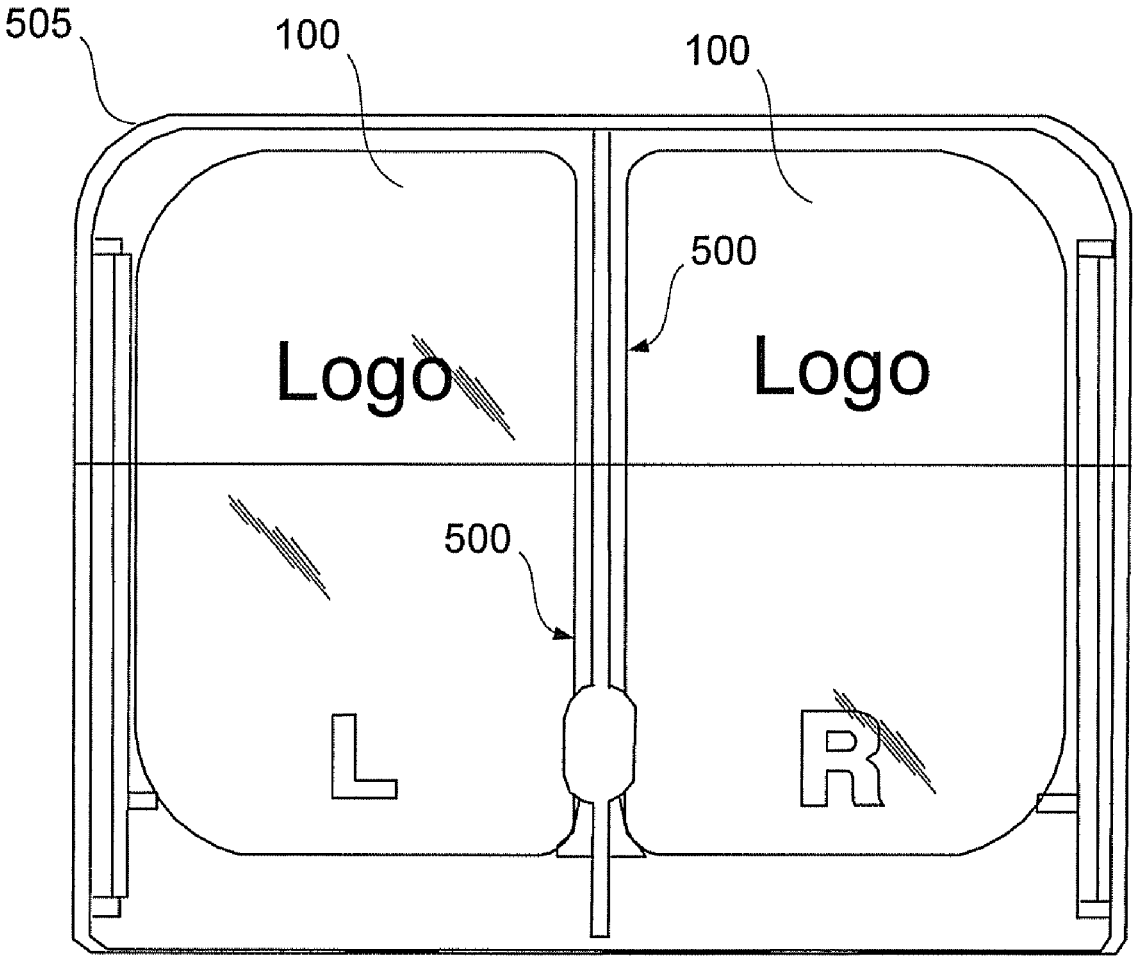
FIG. 44 is a front view of a plurality of contact lens packages in a secondary pack, according to one exemplary embodiment.

Further, as illustrated in FIG. 43, opposing packages meant for different eyes may have opposing edges formed with the linear edge (500) to further facilitate packaging in a secondary pack (505) as illustrated in FIG. 44.

As mentioned previously, the exemplary systems and methods described above may be used to form a packaging for any desired object that could be stored in a sterile environment including, but in no way limited to, intraocular implants, on-lays, sutures, medical implants, medical instruments, dental implants, dental equipment, and the like. Particularly, the ability to manufacture a pre-assembled package including an easily peeled top foil layer and back-loading the contents followed by a permanent seal can be used to manufacture packaging for the medical field, the dental field, the optical field, delicate electronic applications, and the like.

In conclusion, the present contact lens packaging is superior to traditional packaging in many ways. It is much less bulky and can easily be stacked together. This allows for less expensive shipping and is more convenient for consumers to store and carry. The packaging keeps the contact lens in a fixed orientation and position such that the patient can easily remove the lens without searching for it or touching the eye contact surface of the lens with a finger or other un-sterile surface. The manufacturing process is superior to traditional processes because it creates a wider seal to the foil that has less risk of contamination and peels back more uniformly. Additionally, the present exemplary two shot molding process adds the flexibility to incorporate any number of materials into the manufacture of the substrate layer, thereby opening the possibility of incorporating various colors, textures, and mechanical properties without sacrificing sterility.

The preceding description has been presented only to illustrate and describe exemplary embodiments of the system and process. It is not intended to be exhaustive or to limit the system and process to any precise form disclosed. Many modifications and variations are possible in light of the above teaching. It is intended that the scope of the system and process be defined by the following claims.

What is claimed is:

1. A contact lens package, comprising:

a substrate having a top surface, a bottom surface, and an inner wall defining an orifice;

a first non-transmissive sheet removably sealed to said top surface of said substrate over said defined orifice;

a second non-transmissive sheet sealed to said bottom surface of said substrate over said orifice, defining a hermetically sealed cavity; and a contact lens and a hydration medium each disposed in said hermetically sealed cavity between said first and second sheet;

wherein said substrate includes a first non-leaching barrier material and a second material;

wherein said first non-leaching barrier material is formed on said substrate inner wall.

2. The contact lens package of claim 1, wherein said substrate comprises a first portion and a second portion;

said first portion entirely defining a substrate portion of said cavity containing said contact lens; and wherein said first portion of said substrate is formed entirely of said non-leaching barrier material.

3. The contact lens package of claim 2, wherein said first portion of said substrate defines a hermetic barrier layer between said contact lens and said second portion of said substrate when said contact lens is disposed in said orifice;

wherein said second portion of said substrate comprises a different material than said first portion of said substrate.

4. The contact lens package of claim 3, wherein said first non-leaching barrier material comprises a homopolymer polypropylene.

5. The contact lens package of claim 3, wherein said hermetic barrier layer of said first non-leaching barrier material is at least 50 microns thick.

6. The contact lens package of claim 3, wherein said hermetic barrier layer of said first non-leaching barrier material is between 75 microns and 250 microns thick.

7. The contact lens package of claim 2, wherein said package is autoclaved to terminal sterility.

8. The contact lens package of claim 2, wherein said first portion of said substrate and said second portion of said substrate are formed as separate injections of a two-shot mould.

9. The contact lens package of claim 2, further comprising a positioning member disposed in said hermetically sealed cavity with said contact lens.

10. The contact lens package of claim 1, wherein said first non-transmissive sheet and said second non-transmissive sheet each comprise multi-layer laminate foils.

* * * * *